US011452313B2

(12) United States Patent
Kaufman et al.

(10) Patent No.: US 11,452,313 B2
(45) Date of Patent: Sep. 27, 2022

(54) APPARATUS FOR HEATING SMOKABLE MATERIAL

(71) Applicant: British American Tobacco (Investments) Limited, London (GB)

(72) Inventors: Duane A. Kaufman, Hollandale, WI (US); Andrew P. Wilke, Madison, WI (US); Thomas P. Blandino, Cottage Grove, WI (US); James J. Frater, Madison, WI (US); Raymond J. Robey, Madison, WI (US)

(73) Assignee: NICOVENTURES TRADING LIMITED, London (GB)

( * ) Notice: Subject to any disclaimer, the term of this patent is extended or adjusted under 35 U.S.C. 154(b) by 449 days.

(21) Appl. No.: 15/772,382

(22) PCT Filed: Oct. 26, 2016

(86) PCT No.: PCT/EP2016/075734

§ 371 (c)(1),
(2) Date: Apr. 30, 2018

(87) PCT Pub. No.: WO2017/072144

PCT Pub. Date: May 4, 2017

(65) Prior Publication Data

US 2018/0317552 A1 Nov. 8, 2018

Related U.S. Application Data

(63) Continuation of application No. 14/927,529, filed on Oct. 30, 2015, now abandoned.

(51) Int. Cl.
*A24F 40/465* (2020.01)
*H05B 6/10* (2006.01)
(Continued)

(52) U.S. Cl.
CPC ..... *A24F 40/465* (2020.01); *H05B 6/105* (2013.01); *H05B 6/108* (2013.01); *H05B 6/365* (2013.01); *A24D 1/20* (2020.01); *A24F 40/20* (2020.01)

(58) Field of Classification Search
CPC ..... A24F 47/008; A24F 47/00; A24F 15/00; A24F 15/01; A24F 15/015; A24F 40/00;
(Continued)

(56) References Cited

U.S. PATENT DOCUMENTS 219,628 A 9/1879 Edison
219,634 A 9/1879 Gifford
(Continued)

FOREIGN PATENT DOCUMENTS

AT 262137 B 5/1968
AT 306224 B 3/1973
(Continued)

OTHER PUBLICATIONS

Written Opinion and Search Report, International Application No. PCT/EP2016/075734, dated Apr. 6, 2017, 12 pages.
(Continued)

*Primary Examiner* — Dana Ross
*Assistant Examiner* — Joe E Mills, Jr.
(74) *Attorney, Agent, or Firm* — Patterson Thuente Pedersen, P.A.

(57) ABSTRACT

Disclosed is an apparatus for heating smokable material to volatilize at least one component of the smokable material. The apparatus includes a heating zone for receiving an article (1, 2, 3), and a magnetic field generator for generating a varying magnetic field that penetrates the heating zone. The article includes smokable material and heating material that is heatable by penetration with a varying magnetic field to heat the smokable material. The magnetic field generator
(Continued)

includes a magnetically permeable core and a coil. The core includes a magnetically permeable first portion and magnetically permeable first and second arms extending from the first portion. The coil is wound around the first portion of the core. The first and second arms of the core are on different sides of the heating zone.

15 Claims, 2 Drawing Sheets

(51) Int. Cl.
*H05B 6/36* (2006.01)
*A24D 1/20* (2020.01)
*A24F 40/20* (2020.01)

(58) Field of Classification Search
CPC ..... A24F 40/05; A24F 40/10; A24F 40/20; A24F 40/30; A24F 40/40; A24F 40/42; A24F 40/44; A24F 40/46; A24F 40/465; A24F 40/48; A24F 40/485; A24F 40/49; A24F 40/50; A24F 40/51; A24F 40/57; A24F 40/60; A24F 40/65; A24F 40/70; A24F 40/80; A24F 40/08; A24F 40/90; A24F 40/95; H05B 6/105; H05B 6/108; H05B 6/365; H05B 3/36; H05B 6/40; A24D 3/17; A24D 1/22; A24C 5/01; B01F 15/06; B01F 13/08; B01F 13/001
USPC ..... 426/231, 241, 519; 310/82, 90.5, 12.01
See application file for complete search history.

(56) References Cited

U.S. PATENT DOCUMENTS 219,635 A 9/1879 Giles
219,643 A 9/1879 Mattoni
2,462,563 A 2/1949 Seyforth
2,689,150 A 9/1954 Croce
2,888,208 A 5/1959 Rene et al.
3,040,991 A 6/1962 Rene et al.
3,043,524 A 7/1962 Sonia et al.
3,144,174 A 8/1964 Abplanalp
3,258,015 A 6/1966 Drummond et al.
3,289,949 A 12/1966 Willy et al.
3,347,231 A 10/1967 Chien-Hshuing et al.
3,522,806 A 8/1970 Szekely et al.
3,647,143 A 3/1972 Gauthier et al.
3,658,059 A 4/1972 Steil et al.
3,733,010 A 5/1973 Riccio et al.
3,856,185 A 12/1974 Riccio et al.
3,864,326 A 2/1975 Babington
3,913,843 A 10/1975 Cambio, Jr. et al.
3,943,942 A 3/1976 Anderson et al.
4,017,701 A 4/1977 Mittelmann
4,149,548 A 4/1979 Bradshaw
4,284,089 A 8/1981 Ray
4,299,274 A 11/1981 Campbell
4,299,355 A 11/1981 Haekkinen
4,303,541 A 12/1981 Wasel-Nielen et al.
4,393,884 A 7/1983 Jacobs
4,429,835 A 2/1984 Brugger et al.
4,746,067 A 5/1988 Svoboda
4,765,347 A 8/1988 Sensabaugh, Jr. et al.
4,765,348 A 8/1988 Honeycutt
4,771,795 A 9/1988 White et al.
4,776,353 A 10/1988 Lilja et al.
4,819,665 A 4/1989 Roberts et al.
4,827,950 A 5/1989 Banerjee et al.
4,907,606 A 3/1990 Lilja et al.
4,913,168 A 4/1990 Potter et al.
4,917,119 A 4/1990 Potter et al.
4,917,120 A 4/1990 Hill
4,924,883 A 5/1990 Perfetti et al.
4,938,236 A 7/1990 Banerjee et al.
4,941,483 A 7/1990 Ridings et al.
4,947,874 A 8/1990 Brooks et al.
4,955,399 A 9/1990 Potter et al.
4,979,521 A 12/1990 Davis et al.
4,987,291 A 1/1991 McGaffigan et al.
4,991,606 A 2/1991 Serrano et al.
5,019,122 A 5/1991 Clearman et al.
5,020,509 A 6/1991 Suzuki et al.
5,040,552 A 8/1991 Schleich et al.
5,042,509 A 8/1991 Banerjee et al.
5,060,667 A 10/1991 Strubel
5,060,671 A 10/1991 Counts et al.
5,076,292 A 12/1991 Sensabaugh, Jr. et al.
5,080,115 A 1/1992 Templeton
5,093,894 A 3/1992 Deevi et al.
5,095,921 A 3/1992 Losee et al.
5,097,850 A 3/1992 Braunshteyn et al.
5,099,861 A 3/1992 Clearman et al.
5,105,831 A 4/1992 Banerjee et al.
5,119,834 A 6/1992 Shannon et al.
5,133,368 A 7/1992 Neumann et al.
5,144,962 A 9/1992 Counts et al.
5,146,934 A 9/1992 Deevi et al.
5,159,940 A 11/1992 Hayward et al.
5,167,242 A 12/1992 Turner et al.
5,179,966 A 1/1993 Losee et al.
5,188,130 A 2/1993 Hajaligol et al.
5,224,498 A 7/1993 Deevi et al.
5,230,715 A 7/1993 Iizuna et al.
5,235,992 A 8/1993 Sensabaugh, Jr.
5,249,586 A 10/1993 Morgan et al.
5,261,424 A 11/1993 Sprinkel et al.
5,269,327 A 12/1993 Counts et al.
5,272,216 A 12/1993 Clark, Jr. et al.
5,285,798 A 2/1994 Banerjee et al.
5,293,883 A 3/1994 Edwards
5,312,046 A 5/1994 Knoch et al.
5,322,075 A 6/1994 Deevi et al.
5,327,915 A 7/1994 Porenski et al.
5,345,951 A 9/1994 Serrano et al.
5,357,984 A 10/1994 Farrier et al.
5,369,723 A 11/1994 Counts et al.
5,396,911 A 3/1995 Casey, III et al.
5,400,808 A 3/1995 Turner et al.
5,408,574 A 4/1995 Deevi et al.
5,412,183 A 5/1995 Buffenoir et al.
5,415,186 A 5/1995 Casey, III et al.
5,443,560 A 8/1995 Deevi et al.
5,454,363 A 10/1995 Sata
5,461,695 A 10/1995 Knoch
5,474,059 A 12/1995 Cooper
5,483,953 A 1/1996 Cooper
5,499,636 A 3/1996 Baggett, Jr. et al.
5,500,511 A 3/1996 Hansen et al.
5,501,236 A 3/1996 Hill et al.
5,502,743 A 3/1996 Conochie et al.
5,511,538 A 4/1996 Haber et al.
5,517,981 A 5/1996 Taub et al.
5,534,020 A 7/1996 Cheney, III et al.
5,538,020 A 7/1996 Farrier et al.
5,549,906 A 8/1996 Santus
5,564,442 A 10/1996 MacDonald et al.
5,591,368 A 1/1997 Fleischhauer et al.
5,593,792 A 1/1997 Farrier et al.
5,613,505 A 3/1997 Campbell
5,645,749 A 7/1997 Wang
5,649,554 A 7/1997 Sprinkel
5,659,656 A 8/1997 Das
5,687,912 A 11/1997 Denyer
5,699,786 A 12/1997 Oshima et al.
5,711,292 A 1/1998 Hammarlund
5,726,421 A 3/1998 Fleischhauer et al.
5,736,110 A 4/1998 Angelillo et al.
5,778,899 A 7/1998 Saito et al.
5,837,088 A 11/1998 Palmgren et al.
5,845,649 A 12/1998 Saito et al.
5,865,185 A 2/1999 Collins et al.
5,865,186 A 2/1999 Volsey et al.

(56) References Cited

U.S. PATENT DOCUMENTS 5,878,752 A 3/1999 Adams et al.
5,902,501 A 5/1999 Nunnally et al.
5,921,233 A 7/1999 Gold et al.
5,935,486 A 8/1999 Bell et al.
5,938,125 A 8/1999 Ritsche et al.
6,000,394 A 12/1999 Blaha-Schnabel et al.
6,026,820 A 2/2000 Baggett et al.
6,041,790 A 3/2000 Smith et al.
6,053,176 A 4/2000 Adams et al.
6,079,405 A 6/2000 Justo
6,085,741 A 7/2000 Becker
6,089,857 A 7/2000 Matsuura et al.
6,113,078 A 9/2000 Rock
6,125,853 A 10/2000 Susa et al.
6,129,080 A 10/2000 Pitcher et al.
6,158,676 A 12/2000 Hughes
6,164,287 A 12/2000 White
6,178,963 B1 1/2001 Baik
6,209,457 B1 4/2001 Kenworthy et al.
6,223,745 B1 5/2001 Hammarlund et al.
6,230,703 B1 5/2001 Bono
6,234,459 B1 5/2001 Rock
6,244,573 B1 6/2001 Rock
6,248,257 B1 6/2001 Bell et al.
6,267,110 B1 7/2001 Tenenboum et al.
6,283,116 B1 9/2001 Yang
6,289,889 B1 9/2001 Bell et al.
6,297,483 B2 10/2001 Sadahira et al.
6,347,789 B1 2/2002 Rock
6,427,878 B1 8/2002 Greiner-Perth et al.
6,595,209 B1 7/2003 Rose et al.
6,598,607 B2 7/2003 Adiga et al.
6,648,306 B2 11/2003 Rock
6,669,176 B2 12/2003 Rock
6,708,846 B1 3/2004 Fuchs et al.
6,761,164 B2 7/2004 Amirpour et al.
6,769,436 B2 8/2004 Horian
6,799,572 B2 10/2004 Nichols et al.
6,803,545 B2 10/2004 Blake et al.
6,803,550 B2 10/2004 Sharpe
6,886,556 B2 5/2005 Fuchs
6,968,888 B2 11/2005 Kolowich
6,994,096 B2 2/2006 Rostami et al.
7,012,227 B2 3/2006 Tathgur et al.
7,041,123 B2 5/2006 Stapf et al.
7,077,130 B2 7/2006 Nichols et al.
7,081,211 B2 7/2006 Li et al.
7,088,914 B2 8/2006 Whittle et al.
7,163,014 B2 1/2007 Nichols et al.
7,185,659 B2 3/2007 Sharpe
7,234,459 B2 6/2007 Del
7,235,187 B2 6/2007 Li et al.
7,290,549 B2 11/2007 Banerjee et al.
7,303,328 B2 12/2007 Faraldi et al.
7,335,186 B2 2/2008 O'Neil
7,373,938 B2 5/2008 Nichols et al.
7,434,584 B2 10/2008 Steinberg
7,458,374 B2 12/2008 Hale et al.
7,540,286 B2 6/2009 Cross et al.
7,581,540 B2 9/2009 Hale et al.
7,581,718 B1 9/2009 Chang
7,585,493 B2 9/2009 Hale et al.
7,645,442 B2 1/2010 Hale et al.
7,665,461 B2 2/2010 Zierenberg et al.
7,832,397 B2 11/2010 Lipowicz
7,834,295 B2 11/2010 Sharma et al.
7,987,846 B2 8/2011 Hale et al.
8,156,944 B2 4/2012 Han
8,342,184 B2 1/2013 Inagaki et al.
8,365,742 B2 2/2013 Hon
8,375,957 B2 2/2013 Hon
8,402,976 B2 3/2013 Fernando et al.
8,439,046 B2 5/2013 Peters et al.
8,459,271 B2 6/2013 Inagaki
8,689,804 B2 4/2014 Fernando et al.
8,689,805 B2 4/2014 Hon
8,701,682 B2 4/2014 Sherwood et al.
8,707,967 B2 4/2014 Li et al.
9,084,440 B2 7/2015 Zuber et al.
9,125,437 B2 9/2015 Kaljura
9,302,522 B2 4/2016 Sherwood et al.
9,439,454 B2 9/2016 Fernando et al.
9,668,516 B2 6/2017 Sherwood et al.
9,955,726 B2 5/2018 Brinkley et al.
10,130,121 B2 11/2018 Plojoux et al.
10,130,780 B2 11/2018 Talon
10,588,337 B2 3/2020 Prestia et al.
10,881,141 B2 1/2021 Fraser et al.
2001/0042927 A1 11/2001 Rock
2001/0054421 A1 12/2001 Jaser et al.
2002/0043260 A1 4/2002 Layer et al.
2002/0078951 A1 6/2002 Nichols et al.
2002/0078955 A1 6/2002 Nichols et al.
2002/0078956 A1 6/2002 Sharpe et al.
2002/0089072 A1 7/2002 Rock
2002/0121624 A1 9/2002 Usui
2002/0170666 A1 11/2002 Tathgur et al.
2003/0007887 A1 1/2003 Roumpos et al.
2003/0052196 A1 3/2003 Fuchs
2003/0097164 A1 5/2003 Stapf et al.
2003/0101984 A1 6/2003 Li et al.
2003/0105192 A1 6/2003 Li et al.
2003/0106551 A1 6/2003 Sprinkel et al.
2003/0111637 A1 6/2003 Li et al.
2003/0159702 A1 8/2003 Lindell et al.
2003/0209240 A1 11/2003 Hale et al.
2003/0217750 A1 11/2003 Amirpour et al.
2003/0226837 A1 12/2003 Blake et al.
2003/0230567 A1 12/2003 Centanni et al.
2004/0031495 A1 2/2004 Steinberg
2004/0065314 A1 4/2004 Layer et al.
2004/0068222 A1 4/2004 Brian
2004/0083755 A1 5/2004 Kolowich
2004/0149297 A1 8/2004 Sharpe
2004/0177849 A1 9/2004 Del
2004/0234699 A1 11/2004 Hale et al.
2004/0234914 A1 11/2004 Hale et al.
2004/0234916 A1 11/2004 Hale et al.
2004/0255941 A1 12/2004 Nichols et al.
2004/0261782 A1 12/2004 Furumichi et al.
2005/0007870 A1 1/2005 Faraldi et al.
2005/0016549 A1 1/2005 Banerjee et al.
2005/0025213 A1 2/2005 Parks
2005/0031798 A1 2/2005 Tathgur et al.
2005/0045193 A1 3/2005 Yang
2005/0063686 A1 3/2005 Whittle et al.
2005/0079166 A1 4/2005 Damani et al.
2005/0098187 A1 5/2005 Grierson et al.
2005/0133029 A1 6/2005 Nichols et al.
2005/0196345 A1 9/2005 Diederichs et al.
2005/0236006 A1 10/2005 Cowan
2006/0027233 A1 2/2006 Zierenberg et al.
2006/0032501 A1 2/2006 Hale et al.
2006/0043067 A1 3/2006 Kadkhodayan et al.
2006/0102175 A1 5/2006 Nelson
2006/0118128 A1 6/2006 Hoffmann et al.
2006/0137681 A1 6/2006 Von Hollen et al.
2006/0191546 A1 8/2006 Takano et al.
2006/0196518 A1 9/2006 Hon
2006/0196885 A1 9/2006 Leach et al.
2006/0255029 A1* 11/2006 Bone ..... C09J 5/06
219/672
2007/0023043 A1 2/2007 Von et al.
2007/0028916 A1 2/2007 Hale et al.
2007/0031340 A1 2/2007 Hale et al.
2007/0102533 A1 5/2007 Rosell et al.
2007/0125362 A1 6/2007 Ford et al.
2007/0131219 A1 6/2007 Ford et al.
2007/0138207 A1 6/2007 Bonney et al.
2007/0175476 A1 8/2007 Lipowicz
2007/0204864 A1 9/2007 Grychowski et al.
2007/0222112 A1 9/2007 Christ et al.
2007/0235046 A1 10/2007 Gedevanishvili
2007/0267407 A1 11/2007 Loveless et al.

(56) References Cited

U.S. PATENT DOCUMENTS

2007/0283972 A1 12/2007 Monsees et al.
2007/0289720 A1 12/2007 Sunol et al.
2008/0027694 A1 1/2008 Gitman
2008/0031267 A1 2/2008 Imao
2008/0038363 A1 2/2008 Zaffaroni et al.
2008/0149118 A1 6/2008 Oglesby et al.
2008/0149622 A1 6/2008 Weiss et al.
2008/0156326 A1 7/2008 Belcastro et al.
2008/0216828 A1 9/2008 Wensley et al.
2008/0241255 A1 10/2008 Rose et al.
2008/0257367 A1 10/2008 Paterno et al.
2008/0276947 A1 11/2008 Martzel
2008/0312674 A1 12/2008 Chen et al.
2009/0015717 A1 1/2009 Arnao et al.
2009/0071477 A1 3/2009 Hale et al.
2009/0078711 A1 3/2009 Farone et al.
2009/0090349 A1 4/2009 Donovan
2009/0090351 A1 4/2009 Sunol et al.
2009/0095287 A1 4/2009 Emarlou
2009/0107492 A1 4/2009 Ooida
2009/0114215 A1 5/2009 Boeck et al.
2009/0127253 A1 5/2009 Stark et al.
2009/0151717 A1 6/2009 Bowen et al.
2009/0162294 A1 6/2009 Werner
2009/0180968 A1 7/2009 Hale et al.
2009/0199843 A1 8/2009 Farone et al.
2009/0217923 A1 9/2009 Boehm et al.
2009/0230117 A1 9/2009 Fernando et al.
2009/0255923 A1 10/2009 Buehrer et al.
2009/0260641 A1 10/2009 Monsees et al.
2009/0260642 A1 10/2009 Monsees et al.
2009/0280043 A1 11/2009 Ferguson
2009/0301363 A1 12/2009 Damani et al.
2009/0301471 A1 12/2009 Stirzel
2009/0302019 A1 12/2009 Selenski et al.
2010/0006092 A1 1/2010 Hale et al.
2010/0025023 A1 2/2010 Schmidt et al.
2010/0031968 A1 2/2010 Sheikh et al.
2010/0043809 A1 2/2010 Magnon
2010/0065052 A1 3/2010 Sharma et al.
2010/0068154 A1 3/2010 Sharma et al.
2010/0089381 A1 4/2010 Bolmer et al.
2010/0181387 A1 7/2010 Zaffaroni et al.
2010/0236546 A1 9/2010 Yamada et al.
2010/0242974 A1 9/2010 Pan
2010/0258585 A1 10/2010 Jamison
2010/0268212 A1 10/2010 Manwaring et al.
2010/0300467 A1 12/2010 Kuistila et al.
2010/0307518 A1 12/2010 Wang
2010/0313901 A1 12/2010 Fernando et al.
2011/0005535 A1 1/2011 Xiu
2011/0030671 A1 2/2011 Ferguson et al.
2011/0126848 A1 6/2011 Zuber et al.
2011/0192408 A1 8/2011 Inagaki et al.
2011/0240022 A1 10/2011 Hodges et al.
2011/0283458 A1 11/2011 Gillette et al.
2011/0290266 A1 12/2011 Koller
2011/0303230 A1 12/2011 Thiry
2012/0006342 A1 1/2012 Rose et al.
2012/0006343 A1 1/2012 Renaud et al.
2012/0145189 A1 6/2012 Knopow et al.
2012/0234315 A1 9/2012 Li et al.
2013/0061861 A1 3/2013 Hearn
2013/0133675 A1 5/2013 Shinozaki et al.
2013/0152922 A1 6/2013 Benassayag et al.
2014/0196716 A1 7/2014 Liu
2014/0216482 A1 8/2014 Dotan et al.
2014/0238737 A1 8/2014 Backman
2015/0245669 A1 9/2015 Cadieux et al.
2015/0272219 A1 10/2015 Hatrick
2015/0282256 A1 10/2015 Iguro et al.
2015/0302971 A1 10/2015 Wagman et al.
2015/0320116 A1 11/2015 Bleloch et al.
2016/0036222 A1 2/2016 Templeton et al.
2016/0044963 A1 2/2016 Saleem
2016/0150825 A1* 6/2016 Mironov ..... H05B 6/105 219/634
2016/0150828 A1 6/2016 Goldstein et al.
2017/0055574 A1 3/2017 Kaufman et al.
2017/0055575 A1 3/2017 Wilke et al.
2017/0055580 A1 3/2017 Blandino et al.
2017/0055581 A1 3/2017 Wilke et al.
2017/0055582 A1 3/2017 Blandino et al.
2017/0055583 A1 3/2017 Blandino et al.
2017/0055584 A1 3/2017 Blandino et al.
2017/0071250 A1 3/2017 Mironov et al.
2017/0079325 A1 3/2017 Mironov
2017/0086508 A1 3/2017 Mironov et al.
2017/0119046 A1 5/2017 Kaufman et al.
2017/0119047 A1 5/2017 Blandino et al.
2017/0119048 A1 5/2017 Kaufman et al.
2017/0119049 A1 5/2017 Blandino et al.
2017/0119050 A1 5/2017 Blandino et al.
2017/0119051 A1 5/2017 Blandino et al.
2017/0119054 A1 5/2017 Zinovik et al.
2017/0156403 A1 6/2017 Gill et al.
2018/0184713 A1 7/2018 Mironov et al.
2018/0192700 A1 7/2018 Fraser et al.
2018/0235279 A1 8/2018 Wilke et al.
2018/0242633 A1 8/2018 Wilke et al.
2018/0242636 A1 8/2018 Blandino et al.
2018/0249760 A1 9/2018 Kaufman et al.
2018/0279677 A1 10/2018 Blandino et al.
2018/0317553 A1 11/2018 Blandino et al.
2018/0317554 A1 11/2018 Kaufman et al.
2018/0317555 A1 11/2018 Blandino et al.
2018/0325173 A1 11/2018 Blandino et al.
2019/0082738 A1 3/2019 Blandino et al.
2019/0191780 A1 6/2019 Wilke et al.
2019/0230988 A1 8/2019 Aoun
2019/0239555 A1 8/2019 Nicholson
2019/0313695 A1 10/2019 Kaufman
2019/0364973 A1 12/2019 Kaufman et al.
2020/0054068 A1 2/2020 Blandino et al.
2020/0054069 A1 2/2020 Blandino et al.
2020/0229497 A1 7/2020 Aoun et al.
2020/0268053 A1 8/2020 Thorsen et al.
2020/0288774 A1 9/2020 Blandino et al.
2020/0352237 A1 11/2020 Kaufman et al.
2021/0137167 A1 5/2021 Aoun et al.

FOREIGN PATENT DOCUMENTS

AT 321190 B 3/1975
AT 321191 B 3/1975
AU 2002364521 A1 6/2003
CA 2160990 A1 10/1994
CA 2146954 A1 10/1996
CA 2414161 A1 1/2002
CA 2414191 A1 1/2002
CA 2520759 A1 10/2004
CA 2492255 A1 7/2006
CA 2668465 A1 12/2009
CA 2641869 A1 5/2010
CA 2862048 A1 7/2013
CA 2923377 A1 6/2015
CH 513656 A 10/1971
CH 698603 B1 9/2009
CL 2017003408 A1 6/2018
CN 1038085 A 12/1989
CN 1043076 A 6/1990
CN 1045691 A 10/1990
CN 1059649 A 3/1992
CN 2144261 Y 10/1993
CN 1121385 A 4/1996
CN 1123000 A 5/1996
CN 1123001 A 5/1996
CN 1126426 A 7/1996
CN 1158757 A 9/1997
CN 1195270 A 10/1998
CN 1209731 A 3/1999
CN 1287890 A 3/2001
CN 1293591 A 5/2001
CN 1293596 A 5/2001

(56) References Cited

FOREIGN PATENT DOCUMENTS

| | | | |
|---|---|---|---|
| CN | 1130109 | C | 12/2003 |
| CN | 1130137 | C | 12/2003 |
| CN | 1151739 | C | 6/2004 |
| CN | 1575135 | A | 2/2005 |
| CN | 1641976 | A | 7/2005 |
| CN | 201076006 | Y | 6/2008 |
| CN | 101277622 | A | 10/2008 |
| CN | 101390659 | | 3/2009 |
| CN | 201199922 | | 3/2009 |
| CN | 201375023 | Y | 1/2010 |
| CN | 201445686 | U | 5/2010 |
| CN | 101925309 | A | 12/2010 |
| CN | 102212340 | A | 10/2011 |
| CN | 102483237 | A | 5/2012 |
| CN | 102499466 | A | 6/2012 |
| CN | 202351223 | U | 7/2012 |
| CN | 103202540 | A | 7/2013 |
| CN | 203369386 | | 1/2014 |
| CN | 103608619 | A | 2/2014 |
| CN | 103689812 | | 4/2014 |
| CN | 103689815 | A | 4/2014 |
| CN | 103763954 | A | 4/2014 |
| CN | 103974640 | A | 8/2014 |
| CN | 103997922 | A | 8/2014 |
| CN | 104010531 | A | 8/2014 |
| CN | 203748673 | U | 8/2014 |
| CN | 203761188 | U | 8/2014 |
| CN | 203762288 | U | 8/2014 |
| CN | 104039183 | A | 9/2014 |
| CN | 104095291 | | 10/2014 |
| CN | 104095293 | A | 10/2014 |
| CN | 104095295 | | 10/2014 |
| CN | 203952405 | U | 11/2014 |
| CN | 104203016 | A | 12/2014 |
| CN | 104223359 | A | 12/2014 |
| CN | 104256899 | A | 1/2015 |
| CN | 204091003 | | 1/2015 |
| CN | 104540406 | A | 4/2015 |
| CN | 104619202 | A | 5/2015 |
| CN | 104664608 | A | 6/2015 |
| CN | 104677116 | A | 6/2015 |
| CN | 104703308 | A | 6/2015 |
| CN | 104720121 | A | 6/2015 |
| CN | 204519365 | U | 8/2015 |
| CN | 204539505 | U | 8/2015 |
| CN | 204949521 | U | 1/2016 |
| CN | 105307524 | A | 2/2016 |
| CN | 106617325 | A | 5/2017 |
| DE | 360431 | C | 10/1922 |
| DE | 1100884 | B | 3/1961 |
| DE | 1425872 | A1 | 11/1968 |
| DE | 1290499 | B | 3/1969 |
| DE | 1813993 | A1 | 6/1970 |
| DE | 1425871 | B1 | 10/1970 |
| DE | 2315789 | A1 | 10/1973 |
| DE | 4105370 | A1 | 8/1992 |
| DE | 4307144-02 | | 1/1995 |
| DE | 4343578 | A1 | 6/1995 |
| DE | 29509286 | U1 | 8/1995 |
| DE | 4420366 | A1 | 12/1995 |
| DE | 29700307 | U1 | 4/1997 |
| DE | 19854007 | A1 | 5/2000 |
| DE | 19854009 | A1 | 5/2000 |
| DE | 10058642 | A1 | 6/2001 |
| DE | 10007521 | A1 | 8/2001 |
| DE | 10064288 | A1 | 8/2001 |
| DE | 10164587 | A1 | 7/2003 |
| DE | 102005024803 | A1 | 6/2006 |
| DE | 202006013439 | U1 | 10/2006 |
| DE | 102005056885 | A1 | 5/2007 |
| DE | 102006041544 | A1 | 8/2007 |
| DE | 102006041042 | A1 | 3/2008 |
| DE | 102006047146 | A1 | 4/2008 |
| DE | 102007011120 | A1 | 9/2008 |
| DE | 102008034509 | A1 | 4/2009 |
| DE | 102008013303 | A1 | 9/2009 |
| DE | 202009010400 | U1 | 11/2009 |
| DE | 102008038121 | A1 | 2/2010 |
| DE | 202010011436 | U1 | 11/2010 |
| DK | 114399 | B | 6/1969 |
| DK | 488488 | A | 3/1989 |
| DK | 0540774 | T3 | 7/1995 |
| DK | 0540775 | T3 | 8/1997 |
| EP | 0033668 | A1 | 8/1981 |
| EP | 0076897 | A1 | 4/1983 |
| EP | 0033668 | B1 | 6/1983 |
| EP | 0149997 | A2 | 7/1985 |
| EP | 0194257 | A1 | 9/1986 |
| EP | 0371285 | A2 | 6/1990 |
| EP | 0418464 | A2 | 3/1991 |
| EP | 0430559 | | 6/1991 |
| EP | 430566 | | 6/1991 |
| EP | 0503767 | A1 | 9/1992 |
| EP | 0503794 | A1 | 9/1992 |
| EP | 0520231 | A2 | 12/1992 |
| EP | 0430559 | B1 | 3/1995 |
| EP | 0703735 | A1 | 4/1996 |
| EP | 0354661 | B1 | 4/1997 |
| EP | 0540775 | B1 | 7/1997 |
| EP | 0823492 | A2 | 2/1998 |
| EP | 0824927 | A2 | 2/1998 |
| EP | 0857431 | A1 | 8/1998 |
| EP | 0653218 | B1 | 9/1998 |
| EP | 1064083 | A2 | 1/2001 |
| EP | 1064101 | A2 | 1/2001 |
| EP | 1111191 | A2 | 6/2001 |
| EP | 0703735 | | 7/2001 |
| EP | 1128741 | A1 | 9/2001 |
| EP | 1128742 | A1 | 9/2001 |
| EP | 1148905 | A2 | 10/2001 |
| EP | 1203189 | A1 | 5/2002 |
| EP | 1217320 | A2 | 6/2002 |
| EP | 1298993 | A1 | 4/2003 |
| EP | 1299499 | A1 | 4/2003 |
| EP | 1299500 | A2 | 4/2003 |
| EP | 1301152 | A2 | 4/2003 |
| EP | 1349601 | A2 | 10/2003 |
| EP | 1357025 | A2 | 10/2003 |
| EP | 1390112 | A1 | 2/2004 |
| EP | 1409051 | A2 | 4/2004 |
| EP | 1439876 | A2 | 7/2004 |
| EP | 1454840 | | 9/2004 |
| EP | 1454840 | A1 | 9/2004 |
| EP | 1490452 | A2 | 12/2004 |
| EP | 1506792 | A2 | 2/2005 |
| EP | 1609376 | A1 | 12/2005 |
| EP | 1625334 | A2 | 2/2006 |
| EP | 1625335 | A2 | 2/2006 |
| EP | 1625336 | A2 | 2/2006 |
| EP | 1536703 | B1 | 9/2006 |
| EP | 1702639 | A2 | 9/2006 |
| EP | 1749548 | A2 | 2/2007 |
| EP | 1867357 | A1 | 12/2007 |
| EP | 1891867 | A2 | 2/2008 |
| EP | 1940254 | A2 | 7/2008 |
| EP | 1996880 | A2 | 12/2008 |
| EP | 2044967 | A1 | 4/2009 |
| EP | 1357025 | | 7/2009 |
| EP | 2083642 | A1 | 8/2009 |
| EP | 2110034 | A1 | 10/2009 |
| EP | 2138058 | A1 | 12/2009 |
| EP | 2138059 | A1 | 12/2009 |
| EP | 2179229 | A2 | 4/2010 |
| EP | 2191735 | A1 | 6/2010 |
| EP | 2227973 | A1 | 9/2010 |
| EP | 2234508 | A2 | 10/2010 |
| EP | 2241203 | A2 | 10/2010 |
| EP | 2138057 | B1 | 11/2010 |
| EP | 2246086 | A2 | 11/2010 |
| EP | 2249669 | A1 | 11/2010 |
| EP | 2253541 | A1 | 11/2010 |
| EP | 2257195 | A1 | 12/2010 |
| EP | 2277398 | A1 | 1/2011 |
| EP | 2303043 | A2 | 4/2011 |

(56) References Cited

FOREIGN PATENT DOCUMENTS

| | | | |
|---|---|---|---|
| EP | 2316286 | A1 | 5/2011 |
| EP | 2327318 | | 6/2011 |
| EP | 2368449 | A1 | 9/2011 |
| EP | 2003997 | B1 | 10/2011 |
| EP | 2408494 | A1 | 1/2012 |
| EP | 2444112 | | 4/2012 |
| EP | 2253541 | | 5/2012 |
| EP | 2472185 | A1 | 7/2012 |
| EP | 2523752 | A1 | 11/2012 |
| EP | 2542131 | A2 | 1/2013 |
| EP | 2696652 | A1 | 2/2014 |
| EP | 2760303 | A2 | 8/2014 |
| EP | 2907397 | A1 | 8/2015 |
| EP | 2996504 | A1 | 3/2016 |
| ES | 262308 | U | 6/1982 |
| FR | 718708 | A | 1/1932 |
| FR | 1418189 | A | 11/1965 |
| FR | 2573985 | A1 | 6/1986 |
| FR | 2604093 | A1 | 3/1988 |
| FR | 2700697 | A1 | 7/1994 |
| FR | 2730166 | A1 | 8/1996 |
| FR | 2818152 | A1 | 6/2002 |
| FR | 2842791 | B1 | 4/2005 |
| FR | 2873584 | B1 | 11/2006 |
| GB | 347650 | | 4/1931 |
| GB | 353745 | A | 7/1931 |
| GB | 910166 | A | 11/1962 |
| GB | 922310 | A | 3/1963 |
| GB | 958867 | A | 5/1964 |
| GB | 1104214 | A | 2/1968 |
| GB | 1227333 | A | 4/1971 |
| GB | 1379688 | A | 1/1975 |
| GB | 1431334 | A | 4/1976 |
| GB | 2294401 | A | 5/1996 |
| GB | 2323033 | A | 9/1998 |
| GB | 2342874 | A | 4/2000 |
| GB | 2388040 | A | 11/2003 |
| GB | 2412326 | A | 9/2005 |
| GB | 2412876 | A | 10/2005 |
| GB | 2448478 | A | 10/2008 |
| GB | 2487851 | A | 8/2012 |
| GB | 2495923 | | 5/2013 |
| GB | 2504732 | A | 2/2014 |
| IE | 63083 | B1 | 3/1995 |
| IT | 1289590 | B1 | 10/1998 |
| JP | S4961986 | A | 6/1974 |
| JP | S5096908 | A | 8/1975 |
| JP | S5594260 | A | 7/1980 |
| JP | S57110260 | A | 7/1982 |
| JP | S57177769 | A | 11/1982 |
| JP | S63153666 | A | 6/1988 |
| JP | H01191674 | A | 8/1989 |
| JP | H01166953 | U | 11/1989 |
| JP | H0292986 | A | 4/1990 |
| JP | H034479 | A | 1/1991 |
| JP | H03232481 | A | 10/1991 |
| JP | H0851175 | A | 2/1996 |
| JP | 2519658 | B2 | 7/1996 |
| JP | H08228751 | A | 9/1996 |
| JP | H08511175 | A | 11/1996 |
| JP | 3053426 | U | 10/1998 |
| JP | H11503912 | A | 4/1999 |
| JP | H11507234 | A | 6/1999 |
| JP | H11178562 | A | 7/1999 |
| JP | 2000051556 | A | 2/2000 |
| JP | 3016586 | B2 | 3/2000 |
| JP | 2000082576 | A | 3/2000 |
| JP | 2000093155 | A | 4/2000 |
| JP | 3078033 | B2 | 8/2000 |
| JP | 2000515576 | A | 11/2000 |
| JP | 3118462 | B2 | 12/2000 |
| JP | 3118463 | B2 | 12/2000 |
| JP | 2002170657 | A | 6/2002 |
| JP | 2002253593 | A | 9/2002 |
| JP | 2002336290 | A | 11/2002 |
| JP | 2003034785 | A | 2/2003 |
| JP | 3392138 | B2 | 3/2003 |
| JP | 3413208 | B2 | 6/2003 |
| JP | 2004055547 | A | 2/2004 |
| JP | 2004504580 | A | 2/2004 |
| JP | 3588469 | B2 | 11/2004 |
| JP | 2005050624 | A | 2/2005 |
| JP | 2005516647 | A | 6/2005 |
| JP | 2006524494 | A | 11/2006 |
| JP | 2007516015 | A | 6/2007 |
| JP | 2007522900 | A | 8/2007 |
| JP | 2008035742 | A | 2/2008 |
| JP | 2008509907 | A | 4/2008 |
| JP | 2008511175 | A | 4/2008 |
| JP | 2008311058 | A | 12/2008 |
| JP | 2009509523 | A | 3/2009 |
| JP | 2009087703 | A | 4/2009 |
| JP | 2010041354 | A | 2/2010 |
| JP | 2010526553 | A | 8/2010 |
| JP | 2011135901 | A | 7/2011 |
| JP | 2012529936 | A | 11/2012 |
| JP | 2014526275 | A | 10/2014 |
| JP | 2015503336 | A | 2/2015 |
| JP | 2015503337 | A | 2/2015 |
| JP | 2015060837 | A | 3/2015 |
| JP | 2015506170 | A | 3/2015 |
| JP | 2015508287 | A | 3/2015 |
| JP | 2015509706 | A | 4/2015 |
| JP | 2015098645 | A | 5/2015 |
| JP | 2015531601 | A | 11/2015 |
| JP | 2016036222 | A | 3/2016 |
| JP | 2016525341 | A | 8/2016 |
| JP | 2017515490 | A | 6/2017 |
| JP | 2017520234 | A | 7/2017 |
| JP | 2017526381 | A | 9/2017 |
| JP | 2017533732 | A | 11/2017 |
| JP | 2018520664 | A | 8/2018 |
| JP | 2021508438 | A | 3/2021 |
| KR | 960702734 | A | 5/1996 |
| KR | 100385395 | B1 | 8/2003 |
| KR | 20040068292 | A | 7/2004 |
| KR | 20070096027 | A | 10/2007 |
| KR | 100971178 | B1 | 7/2010 |
| KR | 20120104533 | A | 9/2012 |
| KR | 20140068808 | A | 6/2014 |
| KR | 20140123487 | A | 10/2014 |
| RU | 2349234 | C2 | 3/2009 |
| RU | 2015105675 | A | 8/2015 |
| RU | 2013155697 | A | 10/2015 |
| SE | 7415242 | A | 6/1975 |
| SE | 502503 | L | 10/2006 |
| TW | 274507 | B | 4/1996 |
| TW | 201325481 | A | 7/2013 |
| WO | WO8404698 | | 12/1984 |
| WO | WO-8601730 | A1 | 3/1986 |
| WO | WO-9013326 | A1 | 11/1990 |
| WO | WO-9406314 | A1 | 3/1994 |
| WO | WO9409842 | | 5/1994 |
| WO | WO 95/27411 | | 10/1995 |
| WO | WO9527411 | | 10/1995 |
| WO | WO-9639880 | A1 | 12/1996 |
| WO | WO-9805906 | A1 | 2/1998 |
| WO | WO-9823171 | A1 | 6/1998 |
| WO | WO-9835552 | A1 | 8/1998 |
| WO | WO-9914402 | A1 | 3/1999 |
| WO | WO-9947273 | A2 | 9/1999 |
| WO | WO-9947806 | A2 | 9/1999 |
| WO | WO-0028843 | A1 | 5/2000 |
| WO | WO-0104548 | A1 | 1/2001 |
| WO | WO-0140717 | A1 | 6/2001 |
| WO | WO-0163183 | A1 | 8/2001 |
| WO | WO-0205620 | A2 | 1/2002 |
| WO | WO-0205640 | A1 | 1/2002 |
| WO | WO-0206421 | A1 | 1/2002 |
| WO | WO-0207656 | A2 | 1/2002 |
| WO | WO-0224262 | A2 | 3/2002 |
| WO | WO-02051466 | A2 | 7/2002 |
| WO | WO-02096532 | A1 | 12/2002 |
| WO | WO02098389 | | 12/2002 |

(56) References Cited

FOREIGN PATENT DOCUMENTS

| | | | |
|---|---|---|---|
| WO | WO-03037412 | A2 | 5/2003 |
| WO | WO-03049792 | A1 | 6/2003 |
| WO | WO-03083007 | A2 | 10/2003 |
| WO | WO-2004098324 | A2 | 11/2004 |
| WO | WO-2004104491 | A2 | 12/2004 |
| WO | WO-2004104492 | A2 | 12/2004 |
| WO | WO-2004104493 | A2 | 12/2004 |
| WO | WO-2006022714 | A1 | 3/2006 |
| WO | WO-2007042941 | A2 | 4/2007 |
| WO | WO 2007/051163 | | 5/2007 |
| WO | WO-2007054167 | A1 | 5/2007 |
| WO | WO-2007078273 | A1 | 7/2007 |
| WO | WO-2007090594 | A1 | 8/2007 |
| WO | WO-2007098337 | A2 | 8/2007 |
| WO | WO-2007116915 | A1 | 10/2007 |
| WO | WO-2008015441 | A1 | 2/2008 |
| WO | WO-2008029381 | A2 | 3/2008 |
| WO | WO-2008051909 | A1 | 5/2008 |
| WO | WO-2008069883 | A1 | 6/2008 |
| WO | WO-2008151777 | A2 | 12/2008 |
| WO | WO-2009006521 | A2 | 1/2009 |
| WO | WO-2009042955 | A2 | 4/2009 |
| WO | WO-2009079641 | A2 | 6/2009 |
| WO | WO-2009092862 | A1 | 7/2009 |
| WO | WO-2009118085 | A1 | 10/2009 |
| WO | WO-2009152651 | A1 | 12/2009 |
| WO | WO-2009155957 | A1 | 12/2009 |
| WO | WO-2009156181 | A2 | 12/2009 |
| WO | WO-2010017586 | A1 | 2/2010 |
| WO | WO-2010041354 | A1 | 4/2010 |
| WO | WO-2010047389 | A1 | 4/2010 |
| WO | WO-2010053467 | A1 | 5/2010 |
| WO | WO-2010060537 | A1 | 6/2010 |
| WO | WO-2010107613 | A1 | 9/2010 |
| WO | WO-2011088132 | A1 | 7/2011 |
| WO | WO-2011101164 | A1 | 8/2011 |
| WO | WO-2011109304 | A2 | 9/2011 |
| WO | WO-2011117580 | A2 | 9/2011 |
| WO | WO-2012054973 | A1 | 5/2012 |
| WO | WO-2012072770 | A1 | 6/2012 |
| WO | WO-2012072790 | A1 | 6/2012 |
| WO | WO-2012078865 | A2 | 6/2012 |
| WO | WO-2012100430 | A1 | 8/2012 |
| WO | WO-2013034455 | A1 | 3/2013 |
| WO | WO-2013034458 | A1 | 3/2013 |
| WO | WO-2013076098 | A2 | 5/2013 |
| WO | WO-2013098395 | A1 | 7/2013 |
| WO | WO-2013098405 | A2 | 7/2013 |
| WO | WO-2013098409 | A1 | 7/2013 |
| WO | WO-2013098410 | A2 | 7/2013 |
| WO | WO-2013102609 | A2 | 7/2013 |
| WO | WO-2014048475 | A1 | 4/2014 |
| WO | WO2014048745 | | 4/2014 |
| WO | WO-2014147114 | A1 | 9/2014 |
| WO | WO-2015051646 | A1 | 4/2015 |
| WO | WO-2015068936 | A1 | 5/2015 |
| WO | WO 2015082648 | | 6/2015 |
| WO | WO-2015082651 | A1 | 6/2015 |
| WO | WO-2015082652 | A1 | 6/2015 |
| WO | WO-2015131058 | A1 | 9/2015 |
| WO | WO-2015177044 | A1 | 11/2015 |
| WO | WO-2015177045 | A1 | 11/2015 |
| WO | WO-2015177255 | A1 | 11/2015 |
| WO | WO-2015177263 | A1 | 11/2015 |
| WO | WO-2015177264 | A1 | 11/2015 |
| WO | WO-2015177265 | A1 | 11/2015 |
| WO | WO-2015177294 | A1 | 11/2015 |
| WO | WO-2015198015 | A1 | 12/2015 |
| WO | WO-2016014652 | A1 | 1/2016 |
| WO | WO-2016075436 | A1 | 5/2016 |
| WO | WO-2016156500 | A1 | 10/2016 |
| WO | WO-2016184928 | A1 | 11/2016 |
| WO | WO-2016184929 | A1 | 11/2016 |
| WO | WO-2016184930 | A1 | 11/2016 |
| WO | WO-2016200815 | A2 | 12/2016 |
| WO | WO-2017001819 | A1 | 1/2017 |
| WO | WO 2017005705 | | 1/2017 |
| WO | WO-2017029268 | A1 | 2/2017 |
| WO | WO-2017029269 | A1 | 2/2017 |
| WO | WO-2017029270 | A1 | 2/2017 |
| WO | WO-2017036950 | A2 | 3/2017 |
| WO | WO-2017036955 | A2 | 3/2017 |
| WO | WO-2017036959 | A1 | 3/2017 |
| WO | WO-2017068094 | A1 | 4/2017 |
| WO | WO-2017068098 | A1 | 4/2017 |
| WO | WO-2017068099 | A1 | 4/2017 |
| WO | WO-2017207581 | A1 | 12/2017 |
| WO | WO-2018002083 | A1 | 1/2018 |
| WO | WO-2018178095 | A1 | 10/2018 |

OTHER PUBLICATIONS

Iorga, Alexandru et al., "Low Curie Temperature in Fe—Cr—Ni—Mn Alloys", U.P.B. Sci.Bull., Series B, vol. 73, Iss.4, 2011. 195-202. 8 pages.

Todaka et al., "Low Curie Temperature Material for Induction Heating Self-Temperature Controlling System", *Journal of Magnetism and Magnetic Materials* 320 (2008), 6 pages. e702-e707.

NeoMax MS-135, from NeoMax Materials Co., Ltd., described at the following URL: http://www.neomax-materials.co.jp/eng/pr0510.htm, as accessed on Oct. 30, 2015.

Canada Office Action, Application No. 3,003,514, dated Mar. 28, 2019, 6 pages.

Chaplin M., "Hydrocolloids and Gums," retrieved from http://www1.lsbu.ac.uk/water/hydrocolloids_gums.html, Established in 2001, 7 pages.

Chinese Office Action, Application No. 2016800498156, dated Oct. 21, 2019, 20 pages.

CN203762288U, "Atomization Device Applicable to Solid Tobacco Materials and Electronic Cigarette," retrieved from Google Patents https://patents.google.com/patent/CN203762288U/en on Jan. 12, 2018, 10 pages.

English Translation of Chinese First Office Action, Application No. 2016800498584, dated Nov. 1, 2019, 6 pages.

English translation of CN101390659 dated Aug. 3, 2017, 8 pages.

English Translation of Japanese Office Action, Application No. 2018-519865, dated Jun. 25, 2019, 3 pages.

English Translation of Japanese Office Action, Application No. 2018-521547, dated Jun. 25, 2019, 4 Pages.

English Translation of Japanese Office Action, Application No. 2018-506565, dated Mar. 19, 2019, 4 pages.

English Translation of Korean Office Action, Application No. 10-2018-7006070, dated Feb. 7, 2019, 9 pages.

European Extended Search Report for Application No. 19216472.1 dated Apr. 22, 2020, 13 Pages.

European Search Report for Application No. 19164405.3 dated Aug. 28, 2019, 6 Pages.

Extended European Search Report for Application No. 19165045.6 dated Sep. 6, 2019, 7 Pages.

First Office Action dated Dec. 3, 2015 for Chinese Application No. 201380021387.2, filed Apr. 11, 2011, 20 pages.

First Office Action dated May 5, 2016 for Chinese Application No. 201380048636.7, 25 pages.

Gaohe Q.,"Chinese Scientific Information", May 15, 2010, vol. 10, pp. 132-133.

Ineos., "Typical Engineering Properties of High Density Polyethylene," Olefins and Polymers, USA, retrieved from https://www.ineos.com/globalassets/ineos-group/businesses/ineos-olefins-and-polymers-usa/products/technical-information--patents/ineos-typical-engineering-properties-of-hdpe.pdf, Accessed Dec. 4, 2018, 2 pages.

International Preliminary Report on Patentability for Application No. PCT/EP2013/068797, dated Mar. 31, 2015, 5 pages.

International Preliminary Report on Patentability for Application No. PCT/EP2016/070176, dated Mar. 15, 2018, 12 pages.

International Preliminary Report on Patentability for Application No. PCT/EP2016/070178, dated Mar. 15, 2018, 8 pages.

International Preliminary Report on Patentability for Application No. PCT/EP2016/070182, dated Mar. 15, 2018, 8 pages.

(56) References Cited

OTHER PUBLICATIONS

International Preliminary Report on Patentability for Application No. PCT/EP2016/070185, dated Mar. 15, 2018, 11 pages.
International Preliminary Report on Patentability for Application No. PCT/EP2016/070188, dated Mar. 15, 2018, 8 pages.
International Preliminary Reporton Patentability for Application No. PCT/EP2016/070191, dated Mar. 15, 2018, 8 pages.
International Preliminary Report on Patentability for Application No. PCT/EP2016/075734, dated May 11, 2018, 7 pages.
International Preliminary Report on Patentability for Application No. PCT/EP2016/075739, dated Jan. 16, 2018, 7 pages.
International Preliminary Report on Patentability for Application No. PCT/GB2013/052433, dated Mar. 24, 2015, 9 pages.
International Search Report and Written Opinion for Application No. PCT/EP2013/068797, dated Dec. 9, 2013, 8 pages.
International Search Report and Written Opinion for Application No. PCT/EP2016/070176, dated Apr. 19, 2017, 21 pages.
International Search Report and Written Opinion for Application No. PCT/EP2016/070178, dated Dec. 14, 2016, 10 pages.
International Search Report and Written Opinion for Application No. PCT/EP2016/070182, dated Dec. 12, 2016, 11 pages.
International Search Report and Written Opinion for Application No. PCT/EP2016/070185, dated Apr. 4, 2017, 16 pages.
International Search Report and Written Opinion for Application No. PCT/EP2016/070188, dated Dec. 13, 2016, 10 pages.
International Search Report and Written Opinion for Application No. PCT/EP2016/070191, dated Dec. 13, 2016, 10 pages.
International Search Report and Written Opinion for Application No. PCT/EP2016/075739, dated Feb. 24, 2017, 10 pages.
International Search Report and Written Opinion for Application No. PCT/GB2013/052433, dated Jun. 30, 2014, 16 pages.
Japanese Office Action, Application No. 2018-506553, dated Mar. 19, 2019, 8 pages.
Japanese Office Action, Application No. 2018-506553, dated Nov. 5, 2019, 12 pages.
Japanese Office Action, Application No. 2018-506563, dated May 7, 2019, 4 pages.
jrank.org, "Heat Capacity—Heat Capacity and Calorimetry, Heat Capacity and the Law of Conservation of Energy—Significance of the High Heat Capacity of Water," retrieved from https://science.jrank.org/pages/3265/Heat-Capacity.html, Accessed Jun. 15, 2017, 2 pages.
Notification of Reasons for Refusal dated Feb. 1, 2016 for Japanese Application No. 2015531544, 5 pages.
Office Action and Search Report dated May 6, 2020 for Chinese Application No. 2016800498156 filed Aug. 26, 2016, 7 pages.
Office Action and Search Report dated Feb. 27, 2020 for TaiwanApplication No. 105127626 filed Aug. 29, 2016, 14 pages. (Translation available for only Search Report).
Office Action dated Nov. 12, 2019 for Japanese Application No. 2018-506575, 8 pages.
Office Action dated Dec. 19, 2019 for Taiwan Application No. 105127627, 14 pages.
Office Action dated Mar. 19, 2019 for Japanese Application No. 2018-506575, 10 pages.
Office Action dated Mar. 26, 2019 for Japanese Application No. 2018-506381, 22 pages.
Office Action dated Oct. 29, 2019 for Japanese Application No. 2018-507624, 29 pages.
Office Action dated Dec. 3, 2019 for Japanese Application No. 2018-506381, 8 pages.
Office Action dated Nov. 4, 2019 for Chinese Application No. 201680049679.0, 12 pages.
Office Action dated Nov. 5, 2019 for Japanese Application No. 2018-506565, 12 pages.
Office Action dated Aug. 29, 2019 for Korean Application No. 10-2018-7006009, 9 pages.
Office Action dated Feb. 13, 2019 for Japanese Application No. 2018-507624, 32 pages.
Office Action dated Feb. 14, 2019 for Canadian Application No. 2996835, 3 pages.
Office Action dated Feb. 19, 2019 for Canadian Application No. 2995315, 4 pages.
Office Action dated Feb. 8, 2019 for Korean Application No. 10-2018-7006077, 8 pages (15 pages with translation).
Office Action dated Jan. 8, 2019 for Japanese Application No. 2017-075527, 15 pages.
Office Action dated Jan. 31, 2019 for Korean Application No. 10-2018-7006009, 17 pages.
Office Action dated Mar. 13, 2018 for Japanese Application No. 2017-075527, 10 pages.
Office Action dated Sep. 13, 2017 for Russian Application No. 2015106592/12, 6 pages.
Rasidek N.A.M., et al., "Effect of Temperature on Rheology Behaviour of Banana Peel Pectin Extracted Using Hot Compressed Water," Jurnal Teknologi (Sciences & Engineering), vol. 80 (3), Apr. 1, 2018, pp. 97-103.
Second Office Action dated Jan. 16, 2017 for Chinese Application No. 201380048636.7, 24 pages.
The Engineering Toolbox., "Specific Heats for Metals," retrieved from https://www.engineeringtoolbox.com/specific-heat-metals-d_152.html, 2003, 6 pages.
UKIPO Search Report for UK Application No. GB1216621.1, dated Jan. 17, 2013, 6 pages.
University of Illinois, "Scientific Principles," retrieved from http://matse1.matse.illinois.edu/ceramics/prin.html, Accessed Jun. 15, 2017, 13 pages.
Application and File History for U.S. Appl. No. 14/428,626, filed Mar. 16, 2015, Inventor Brereton.
Application and File History for U.S. Appl. No. 14/927,532, filed Oct. 30, 2015, Inventor Blandino.
Application and File History for U.S. Appl. No. 15/772,386, filed Apr. 30, 2018, Inventor: Blandino.
Application and File History for U.S. Appl. No. 14/840,652, filed Aug. 31, 2015, Inventor: Blandino.
Application and File History for U.S. Appl. No. 15/754,801, filed Feb. 23, 2018, Inventor: Blandino.
Application and File History for U.S. Appl. No. 14/840,703, filed Aug. 31, 2015, Inventor Wilke.
Application and File History for U.S. Appl. No. 15/754,809, filed Feb. 23, 2018, Inventor Wilke.
Application and File History for U.S. Appl. No. 14/840,731, filed Aug. 31, 2015, Inventor Wilke.
Application and File History for U.S. Appl. No. 15/754,812, filed Feb. 23, 2018, Inventor: Blandino.
Application and File History for U.S. Appl. No. 14/840,854, filed Aug. 31, 2015, Inventor Wilke.
Application and File History for U.S. Appl. No. 15/754,823, filed Feb. 23, 2018, Inventor: Blandino.
Application and File History for U.S. Appl. No. 14/840,972, filed Aug. 31, 2015, Inventor: Blandino.
Application and File History for U.S. Appl. No. 15/754,837, filed Feb. 23, 2018, Inventor Wilke.
Application and File History for U.S. Appl. No. 14/840,751, filed Aug. 31, 2015, Inventor Blandino.
Application and File History for U.S. Appl. No. 15/754,818, filed Feb. 23, 2018, Inventor Blandino.
CN203762288, Machine Translation, retrieved Online from Espacenet on Aug. 13, 2020, (http://worldwide.espacenet.com), 5 pages.
Extended European Search Report for Application No. 20179569.7 dated Oct. 2, 2020, 10 pages.
Office Action dated Aug. 5, 2020 for Chinese Application No. 201680049874.3, 6 pages.
Office Action for Chinese Application No. 20168049858dated Jul. 3, 2020, 35 pages.
Office Action dated Sep. 1, 2020 for Japanese Application No. 2018-506381, 25 pages.
Office Action dated Sep. 15, 2020 for Japanese Application No. 2019-118784, 14 pages.
Office Action dated Sep. 17, 2020 for Canadian Application No. 2996342, 4 pages.

(56) References Cited

OTHER PUBLICATIONS

Office Action dated Jun. 19, 2020 for Canadian Application No. 2995315, 4 pages.
Office Action dated Sep. 29, 2020 for Japanese Application No. 2018-506563, 5 pages.
Shuisheng X., et al., "Semisolid processing technology," Jinshu Bangutai Jiagong Jishu, 2012, ISBN 978-7-5024-5935-2, 10 pages.
Application and File History for U.S. Appl. No. 14/927,529, filed Oct. 30, 2015, inventors Kaufman et al.
Application and File History for U.S. Appl. No. 14/927,537, filed Oct. 30, 2015, inventors Kaufman et al.
Application and File History for U.S. Appl. No. 14/927,539, filed Oct. 30, 2015, inventors Blandino et al.
Application and File History for U.S. Appl. No. 14/927,551, filed Oct. 30, 2015, inventors Blandino et al.
Application and File History for U.S. Appl. No. 14/927,556, filed Oct. 30, 2015, inventors Blandino et al., 60 pages.
European Notice of Opposition for U.S. Appl. No. 13759,537 dated Jan. 23, 2020, 83 pages.
Office Action dated Oct. 18, 2019 for Chinese Application No. 201680049874.3, 18 pages.
Office Action dated Sep. 12, 2019 for Chilean Application No. 201800521, 8 pages.
Office Action dated May 15, 2020 for the Brazilian Application No. 112018004103.3.
Office Action dated Dec. 3, 2019 for Japanese Application No. 2018-521547, 4 pages.
Office Action dated Jun. 9, 2020 for Chinese Application No. 201680061969.7, 15 pages.
"Polyetheretherketone—Online Catalog Source," Retrieved from http://www.goodfellow.com/A/Polyethertherketone.html, Jan. 17, 2020. 4 pages.
Extended European Search Report for Application No. 20205043.1, dated May 4, 2021, 10 pages.
Extended European Search Report For Application No. 20205544.8 dated Jun. 14, 2021, 9 pages.
Extended European Search Report for Application No. EP20205075.3, dated Jan. 27, 2021, 11 pages.
International Search Report and Written Opinion for Application No. PCT/EP2016//085686, dated May 9, 2019, 16 pages.
Jinshu Bangutai Jiagong Jishu, Metallurgical Industry Press, 10 pages, dated Jun. 30, 2012.
Notification of Reasons for Refusal dated May 18, 2021 for Japanese Application No. 2020126181, 8 pages.
Office Action dated Feb. 15, 2021 for Ukraine Application No. 201801751, 4 pages.
Office Action dated Feb. 16, 2021 for Ukraine Application No. 201801846, 3 pages.
Office Action dated Jan. 28, 2021 for Chinese Application No. 201680049874.3, 6 pages.
Office Action For Chinese Application No. 201680049479.5, dated Feb. 4, 2021, 8 pages.
Office Action For Japanese Application No. 2018-506381, dated Apr. 13, 2021, 5 pages.
Office Action for Malaysian Application No. PI2018700428, dated Mar. 1, 2021, 3 pages.
Office action dated Sep. 8, 2020 for Japanese Application No. 2018-507624, 7 pages.
Partial European Search Report for Application No. 20205057.1, dated Apr. 29, 2021, 16 pages.
Office Action For Russian Application No. 2020135756, dated Jun. 30, 2021, 9 pages.
Chinese Office Action, Chinese Application No. 2016800498584, dated Jul. 1, 2021, 13 pages.
CN-203952405-U, "Tobacco Suction System Based on Electromagnetic Heating—Google Patents," (Machine Translation) [online], Retrieved on Nov. 29, 2021, Retrieved from Google Patents (https://patents.google.com/), 2014, 4 pages.
Decision to Grant a Patent dated Apr. 5, 2022 for Japanese Application No. 2020-182759, 5 pages.
Extended European Search Report for Application No. 20205057.1, dated Oct. 19, 2021, 20 pages.
Extended European Search Report for Application No. 21170804.5, dated Feb. 21, 2022, 13 pages.
Extended European Search Report for Application No. 21192233.1, dated Dec. 9, 2021, 11 pages.
Fourth Office Action and Search Report for Chinese Application No. 201680049479.5 dated Nov. 18, 2021, 20 pages.
Fourth Office Action and Search Report for Chinese Application No. 2016800498584 dated Jan. 6, 2022, 21 pages.
Notice of Reasons for Refusal dated Nov. 2, 2021 for Japanese Application No. 2020-182712, 6 pages.
Notice of Reasons for Refusal dated Jan. 25, 2022 for Japanese Application No. 2020-183045, 9 pages.
Notice of Reasons for Rejection for Japanese Application No. 2020-182759, dated Oct. 12, 2021, 5 pages.
Notice of Reasons for Rejection for Japanese Application No. 2020-182762, dated Dec. 7, 2021, 9 pages.
Notice of Reasons for Rejection dated Jan. 19, 2022 for Japanese Application No. 2020-183046, 6 pages.
Office Action For Chinese Application No. 201680049858.4, dated Apr. 1, 2022, 15 pages.
Office Action For Japanese Application No. 2020-067569, dated Nov. 9, 2021, 6 pages.
Office Action For Japanese Application No. 2020-126181, dated Nov. 30, 2021,4 pages.
Office Action For Japanese Application No. 2020-183056, dated Nov. 9, 2021, 14 pages.
Office Action For Russian Application No. 2018115288, dated Oct. 17, 2018, 7 pages.
Office Action For Russian Application No. 2020121132, dated Aug. 6, 2021, 11 pages.
Office Action dated Jun. 8, 2021 for Japanese Application No. 2020-526233, 22 pages.
Office Action dated Sep. 17, 2020 for Canadian Application No. 2995315, 4 pages.
Partial European Search Report for Application No. 21170791.4, dated Nov. 22, 2021, 16 pages.
Physics., "Analysis Series of Typical Examples of College Entrance Examination," Editorial Board, Heilongjiang Science and Technology Press, Dec. 31, 1995, 47 pages.
Search Report for Japanese Application No. 2020-521547, dated Jun. 14, 2019, 22 pages.
Written Opinion of the International Preliminary Examining Authority for Application No. PCT/EP2016/075739, dated Sep. 28, 2017, 6 pages.

* cited by examiner

APPARATUS FOR HEATING SMOKABLE MATERIAL

PRIORITY CLAIM

The present application is a National Phase entry of PCT Application No. PCT/EP2016/075734, filed Oct. 26, 2016, which claims priority from U.S. patent application Ser. No. 14/927,529, filed Oct. 30, 2015, each of which is hereby fully incorporated herein by reference.

TECHNICAL FIELD

The present disclosure relates to apparatus for heating smokable material, such as tobacco, to volatilize at least one component of the smokable material, and to systems comprising such apparatus and articles comprising such smokable material and for use with such apparatus.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present disclosure provides an apparatus for heating smokable material to volatilize at least one component of the smokable material, the apparatus comprising: a heating zone for receiving an article, the article comprising smokable material and heating material that is heatable by penetration with a varying magnetic field to heat the smokable material; and a magnetic field generator for generating a varying magnetic field that penetrates the heating zone, the magnetic field generator comprising a magnetically permeable core and a coil; wherein the core comprises a magnetically permeable first portion and magnetically permeable first and second arms extending from the first portion, wherein the coil is wound around the first portion of the core, and wherein the first and second arms of the core are on different sides of the heating zone.

In an exemplary embodiment, the first and second arms of the core have respective free ends on different sides of the heating zone.

In an exemplary embodiment, the first and second arms of the core are on opposite sides of the heating zone.

In an exemplary embodiment, the first and second arms of the core have respective free ends on opposite sides of the heating zone.

In an exemplary embodiment, the respective free ends of the first and second arms of the core face each other through the heating zone.

In an exemplary embodiment, the heating zone is elongate, and each of the first and second arms of the core is elongate in a direction parallel to a longitudinal axis of the heating zone.

In an exemplary embodiment, the first and second arms of the core extend from opposite ends of the first portion of the core.

In an exemplary embodiment, the core comprises third and fourth arms extending from the first portion, and the third and fourth arms of the core are on opposite sides of the heating zone.

In an exemplary embodiment, the first and third arms of the core extend from a first end of the first portion of the core, and the second and fourth arms of the core extend from an opposite second end of the first portion of the core.

In an exemplary embodiment, the first, second, third and fourth arms connect the first portion of the core to a second portion of the core, and wherein the second portion of the core is on an opposite side of the heating zone from the first portion of the core.

In an exemplary embodiment, the magnetic field generator comprises a second coil wound around the second portion of the core.

In an exemplary embodiment, the heating zone has an open first end through which the article is insertable into the heating zone, a second end opposite the first end, and one or more sides connecting the first and second ends; and the first arm of the core is at the side, or one of the sides, of the heating zone, and the second arm of the core is at the second end of the heating zone.

In an exemplary embodiment, the first and second arms of the core have respective free ends; and the free end of the first arm of the core is at the side, or one of the sides, of the heating zone, and the free end of the second arm of the core is at the second end of the heating zone.

In an exemplary embodiment, the respective free ends of the first and second arms of the core face the heating zone.

In an exemplary embodiment, the magnetic field generator comprises a magnetically permeable second core; and the second core comprises a magnetically permeable first portion and magnetically permeable first and second arms extending from the first portion, the second coil is wound around the first portion of the second core, and the first and second arms of the second core have respective free ends that face the heating zone.

In an exemplary embodiment, the core comprises, or is composed of, ferrite.

In an exemplary embodiment, the first portion of the core is unitary with each of the first and second arms of the core.

In an exemplary embodiment, the heating zone is a recess in the apparatus. In an exemplary embodiment, the heating zone is a recess in the core.

In an exemplary embodiment, the core is comprises, or is composed of, ferrite.

In an exemplary embodiment, the core comprises plural layers of electrically-conductive material that are isolated from one another by non-electrically-conductive material.

In an exemplary embodiment, the coil extends along an axis that is perpendicular to a longitudinal axis of the heating zone.

In an exemplary embodiment, the coil extends along an axis that is parallel to a longitudinal axis of the heating zone.

In an exemplary embodiment, the apparatus is for heating smokable material to volatilize at least one component of the smokable material without burning the smokable material.

A second aspect of the present disclosure provides a system, comprising: an article comprising smokable material and a heater, wherein the heater comprises heating material that is heatable by penetration with a varying magnetic field to heat the smokable material; and apparatus for heating the smokable material to volatilize at least one component of the smokable material, the apparatus comprising: a heating zone for receiving the article; and a magnetic field generator for generating a varying magnetic field that penetrates the heater when the article is in the heating zone, the magnetic field generator comprising a magnetically permeable core and a coil; wherein the core comprises a magnetically permeable first portion and magnetically permeable first and second arms extending from the first portion, wherein the coil is wound around the first portion of the core, and wherein the first and second arms of the core are on different sides of the heating zone.

In an exemplary embodiment, the magnetic field generator comprises a magnetically permeable second core and a second coil; and the second core comprises a magnetically permeable first portion and magnetically permeable first and second arms extending from the first portion, the second coil is wound around the first portion of the second core, and the first and second arms of the second core have respective free ends that face the heating zone.

In an exemplary embodiment, the article comprises a second heater comprising heating material that is heatable by penetration with a varying magnetic field to heat the smokable material, and the respective free ends of the first and second arms of the second core face the second heater when the article is in the heating zone.

In an exemplary embodiment, the smokable material of the article is located between the heater and the second heater.

In an exemplary embodiment, the smokable material comprises tobacco and/or one or more humectants.

In an exemplary embodiment, the heating material comprises one or more materials selected from the group consisting of: an electrically-conductive material, a magnetic material, and a magnetic electrically-conductive material.

In an exemplary embodiment, the heating material comprises a metal or a metal alloy.

In an exemplary embodiment, the heating material comprises one or more materials selected from the group consisting of: aluminum, gold, iron, nickel, cobalt, conductive carbon, graphite, plain-carbon steel, stainless steel, ferritic stainless steel, copper, and bronze.

In an exemplary embodiment, the article of the system is the article of the first aspect of the present disclosure. The article of the system may have any one or more of the features discussed above as being present in respective exemplary embodiments of the article of the first aspect of the present disclosure.

BRIEF DESCRIPTION OF THE DRAWINGS

Embodiments of the disclosure will now be described, by way of example only, with reference to the accompanying drawings, in which.

DETAILED DESCRIPTION

Figure 1:
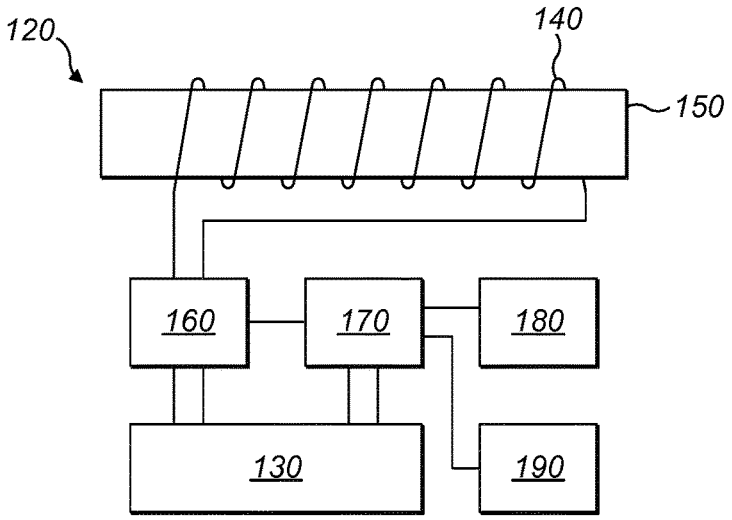
FIG. 1 shows a schematic view of an example of a magnetic field generator of apparatus for heating smokable material to volatilize at least one component of the smokable material.

As used herein, the term "smokable material" includes materials that provide volatilized components upon heating, typically in the form of vapor or an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, reconstituted tobacco, reconstituted smokable material, liquid, gel, gelled sheet, powder, or agglomerates, or the like. "Smokable material" also may include other, non-tobacco, products, which, depending on the product, may or may not contain nicotine. "Smokable material" may comprise one or more humectants, such as glycerol or propylene glycol.

As used herein, the term "heating material" or "heater material" refers to material that is heatable by penetration with a varying magnetic field.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, gel, powder, or the like.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

Referring to FIG. 1, there is shown a schematic view of an example of a magnetic field generator 120 of apparatus for heating smokable material to volatilize at least one component of the smokable material, in accordance with an embodiment of the present disclosure. The magnetic field generator 120 shown in FIG. 1 is included in the respective apparatuses 100, 200, 300 described below with reference to FIGS. 2 to 4, respectively. However, in other embodiments, the apparatus 100, 200, 300 may comprise a different magnetic field generator to that shown in FIG. 1.

In this embodiment, the magnetic field generator 120 comprises an electrical power source 130, a coil 140, a magnetically permeable core 150, a device 160 for passing a varying electrical current, such as an alternating current, through the coil 140, a controller 170, a user interface 180 for user-operation of the controller 170, and a temperature sensor 190.

In this embodiment, the electrical power source 130 is a rechargeable battery. In other embodiments, the electrical power source 130 may be other than a rechargeable battery, such as a non-rechargeable battery, a capacitor, a battery-capacitor hybrid, or a connection to a mains electricity supply.

The coil 140 may take any suitable form. In this embodiment, the coil 140 is a helical coil of electrically-conductive material, such as copper. The coil 140 is wound or wrapped around a portion of the magnetically permeable core 150.

The magnetically permeable core 150 concentrates the magnetic flux produced by the coil 140 in use and makes a more powerful magnetic field. Furthermore, the magnetically permeable core 150 helps to direct the magnetic flux to its intended target. The intended target in the embodiments discussed below is a heater 20, 22 of an article 1, 2, 3. The heater 20, 22 comprises heating material that is heatable by penetration with a varying magnetic field. Example such heating materials are discussed below. In the embodiments described below, the heater 20, 22 is for heating smokable material 10 of the article 1, 2, 3. In some embodiments, the coil 140 may be wound around only a portion (i.e. not all) of the magnetically permeable core 150.

The magnetically permeable core 150 preferably has high magnetic permeability and low electrical conductivity. The latter helps prevent the generation of eddy currents in the magnetically permeable core 150 in use, which helps to prevent the magnetically permeable core 150 becoming heated in use.

In each of the embodiments described herein with reference to FIGS. 1 to 4, the magnetically permeable core 150 comprises, or is composed of, ferrite. The ferrite may, for example, contain iron oxide combined with nickel and/or zinc and/or manganese. The ferrite may have a low coercivity and be considered a "soft ferrite", or have a high coercivity and be considered a "hard ferrite". Example usable soft ferrites are manganese-zinc ferrite, with the formula $Mn_aZn_{(1-a)}Fe_2O_4$, and nickel-zinc ferrite, with the formula $Ni_aZn_{(1-a)}Fe_2O_4$. However, in respective variations to these embodiments, the magnetically permeable core 150 may be made of a different material or materials. For example, in some embodiments, the magnetically permeable core 150 may comprise plural layers of electrically-conductive material that are isolated from one another by non-electrically-conductive material. The magnetically permeable core 150 may have dozens, or even hundreds, of layers of electrically-conductive material that are isolated from one another by non-electrically-conductive material.

In this embodiment, the device 160 for passing a varying current through the coil 140 is electrically connected between the electrical power source 130 and the coil 140. In this embodiment, the controller 170 also is electrically connected to the electrical power source 130, and is communicatively connected to the device 160 to control the device 160. More specifically, in this embodiment, the controller 170 is for controlling the device 160, so as to control the supply of electrical power from the electrical power source 130 to the coil 140. In this embodiment, the controller 170 comprises an integrated circuit (IC), such as an IC on a printed circuit board (PCB). In other embodiments, the controller 170 may take a different form. In some embodiments, the apparatus may have a single electrical or electronic component comprising the device 160 and the controller 170. The controller 170 is operated in this embodiment by user-operation of the user interface 180. The user interface 180 may be located at the exterior of the apparatus 100, 200, 300 into which the magnetic field generator 120 is incorporated. The user interface 180 may comprise a push-button, a toggle switch, a dial, a touch-screen, or the like. In other embodiments, the user interface 180 may be remote and connected to the rest of the apparatus wirelessly, such as via Bluetooth.

In this embodiment, operation of the user interface 180 by a user causes the controller 170 to cause the device 160 to cause an alternating electrical current to pass through the coil 140, so as to cause the coil 140 to generate an alternating magnetic field. In the embodiments described below with reference to FIGS. 2 to 4, when the article 1, 2, 3 is located in the heating zone 110, the coil 140 and the heater 20 of the article 1, 2, 3 are suitably relatively positioned so that the alternating magnetic field produced by the coil 140 penetrates the heating material of the heater 20 of the article 1, 2, 3. As further described herein, the magnetically permeable core 150 helps to direct the magnetic field so that the magnetic field penetrates the heating material of the heater 20 of the article 1, 2, 3. When the heating material of the heater 20 of the article 1, 2, 3 is an electrically-conductive material, this may cause the generation of one or more eddy currents in the heating material. The flow of eddy currents in the heating material against the electrical resistance of the heating material causes the heating material to be heated by Joule heating. As mentioned above, when the heating material is made of a magnetic material, the orientation of magnetic dipoles in the heating material changes with the changing applied magnetic field, which causes heat to be generated in the heating material.

In this embodiment, the temperature sensor 190 is for sensing a temperature of the heating zone 110 in use. The temperature sensor 190 is communicatively connected to the controller 170, so that the controller 170 is able to monitor the temperature of the heating zone 110. In some embodiments, the temperature sensor 190 may be arranged to take an optical temperature measurement of the heating zone 110 or article 1, 2, 3. In some embodiments, the article 1, 2, 3 may comprise a temperature detector, such as a resistance temperature detector (RTD), for detecting a temperature of the article 1, 2, 3. The article 1, 2, 3 may further comprise one or more terminals connected, such as electrically-connected, to the temperature detector. The terminal(s) may be for making connection, such as electrical connection, with a temperature monitor of the magnetic field generator when the article 1, 2, 3 is in the heating zone 111. The controller 170 may comprise the temperature monitor. The temperature monitor of the apparatus 100 may thus be able to determine a temperature of the article 1, 2, 3 during use of the article 1, 2, 3 with the apparatus 100, 200, 300.

In some embodiments, by providing that the heating material of the heater 20 of the article 1, 2, 3 has a suitable resistance, the response of the heating material to a change in temperature could be sufficient to give information regarding temperature inside the article 1, 2, 3. The temperature sensor 190 may then comprise a probe for analyzing the heating material.

On the basis of one or more signals received from the temperature sensor 190 or temperature detector, the controller 170 may cause the device 160 to adjust a characteristic of the varying or alternating electrical current passed through the coil 140 as necessary, in order to ensure that the temperature of the heating zone 110 remains within a predetermined temperature range. The characteristic may be, for example, amplitude or frequency. Within the predetermined temperature range, in use the smokable material 10 within an article 1, 2, 3 located in the heating zone 110 is heated sufficiently to volatilize at least one component of the smokable material 10 without combusting the smokable material 10. Accordingly, the controller 170, and the apparatus 100, 200, 300 as a whole, is arranged to heat the smokable material 10 to volatilize the at least one component of the smokable material 10 without combusting the smokable material 10. In some embodiments, the temperature range is about 50° C. to about 300° C., such as between about 50° C. and about 250° C., between about 50° C. and about 150° C., between about 50° C. and about 120° C., between about 50° C. and about 100° C., between about 50° C. and about 80° C., or between about 60° C. and about 70° C. In some embodiments, the temperature range is between about 170° C. and about 220° C. In other embodiments, the temperature range may be other than this range.

In some embodiments, the temperature sensor 190 may be omitted.

Figure 2:
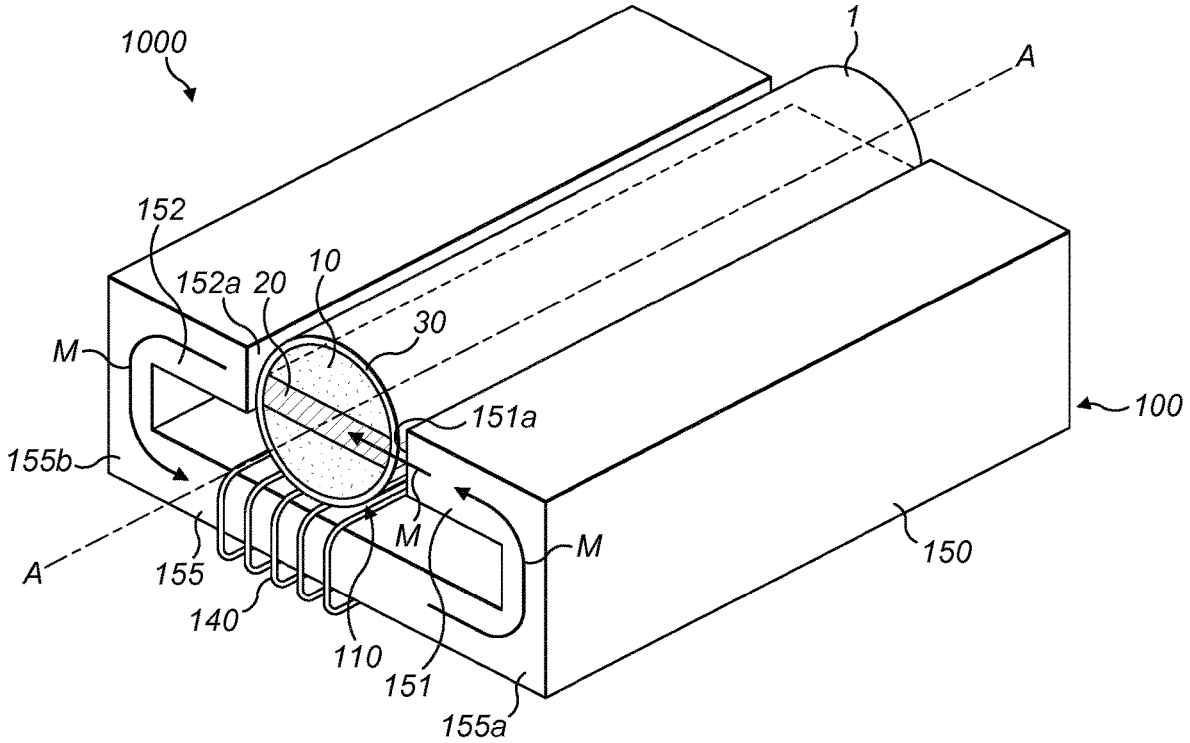
FIG. 2 shows a schematic perspective view of an example of a system, the system comprising an article comprising smokable material, and apparatus for heating the smokable material to volatilize at least one component of the smokable material.

Referring to FIG. 2, there is shown a schematic perspective view of an example of a system according to an embodiment of the present disclosure. The system 1000 comprises an article 1 comprising smokable material 10, and apparatus 100 for heating the smokable material 10 to volatilize at least one component of the smokable material 10. In this embodiment, the apparatus 100 is for heating the smokable material 10 to volatilize at least one component of the smokable material 10 without burning the smokable material 10.

In this embodiment, the article 1 of the system 1000 comprises a heater 20 comprising heating material. The heating material is heatable by penetration with a varying magnetic field. The heater 20 is within the smokable material 10. In other embodiments, the smokable material 10 may be on only one side of the heater 20. The article 1 also comprises a cover 30 that encircles the smokable material 10 and the heater 20 to help maintain the relative positions of the smokable material 10 and the heater 20. The cover 30 may thermally insulate the interior of the cover 30 from the exterior of the cover 30. The cover 30 may electrically insulate the heater 20 from the core 150. The cover 30 may be made of any suitable material, such as paper, card, a plastics material, or the like. In other embodiments, the cover 30 may take a different form or be omitted.

In this embodiment, the article 1 is elongate and cylindrical with a substantially circular cross section in a plane normal to a longitudinal axis of the article 1. However, in other embodiments, the article 1 may have a cross section other than circular and/or not be elongate and/or not be cylindrical. The article 1 may have proportions approximating those of a cigarette.

In this embodiment, the apparatus 100 comprises a heating zone 110 for receiving the article 1, and the magnetic field generator 120 shown schematically in FIG. 1. In this embodiment, the heating zone 110 is a recess in the apparatus 100. Moreover, in this embodiment, the heating zone 110 is a recess in the core 150. More specifically, in this embodiment, the recess 110 is elongate and has a longitudinal axis A-A. Furthermore, although not expressly shown in FIG. 2, in this embodiment the recess 110 is cylindrical with a substantially circular cross section in a plane normal to the longitudinal axis A-A of the recess 110. In other embodiments, the heating zone 110 may have a cross section other than circular and/or not be elongate and/or not be cylindrical. In this embodiment, the article 1 and the recess 110 are relatively dimensioned so that the article 1 is a snug fit in the recess 110.

In this embodiment, the core 150 of the magnetic field generator 120 comprises a magnetically permeable first portion 155, a magnetically permeable first arm 151, and a magnetically permeable second arm 152. The first arm 151 extends from a first end 155*a* of the first portion 155 of the core 150, and the second arm 152 extends from a second end 155*b* of the first portion 155 of the core 150. The second end 155*b* of the first portion 155 is opposite from the first end 155*a* of the first portion 155.

In this embodiment, the first and second arms 151, 152 of the core 150 are on opposite sides of the heating zone 110. More specifically, in this embodiment, the first and second arms 151, 152 of the core 150 have respective free ends 151*a*, 152*b* on opposite sides of the heating zone 110. The respective free ends 151*a*, 152*a* of the first and second arms 151, 152 of the core 150 face each other through the heating zone 110. Furthermore, in this embodiment, each of the first and second arms 151, 152 of the core 150 is elongate in a direction parallel to the longitudinal axis A-A of the heating zone 110.

In this embodiment, a cross-sectional shape of each of the first and second arms 151, 152 of the core 150 in a plane normal to the longitudinal axis A-A of the heating zone 110 is substantially L-shaped. In other embodiments, the cross-sectional shape may be other than L-shaped, such as a 45-degree arc or bend. In this embodiment, each of the first and second arms 151, 152 of the core 150 meets the first portion 155 of the core 150 at substantially ninety degrees. In other embodiments, this angle may be other than ninety degrees, such as between 10 and 170 degrees, between 30 and 150 degrees, between 45 degrees and 135 degrees, or between 60 and 120 degrees.

In this embodiment, the coil 140 is wound around the first portion 155 of the core 150. In this embodiment, the coil 140 is wound around neither of the first and second arms 151, 152 of the core 150. In this embodiment, the coil 140 extends generally along an axis that is perpendicular to the longitudinal axis A-A of the heating zone 110. The volume encircled by the coil 140 comprises the first portion 155 of the core 150 and is free of the heating zone 110. That is, the coil 140 does not encircle the heating zone 110. Accordingly, some portions of the coil 140 are located between the first portion 155 of the core 150 and the heating zone 110, and the first portion 155 of the core 150 is located between some other portions of the coil 140 and the heating zone 110.

The apparatus 100 and the article 1 are relatively dimensioned so that, when the article 1 located is in the heating zone 110, as shown in FIG. 2, the varying magnetic field generated by the magnetic field generator 120 penetrates the heater 20 of the article 1. The geometry of the core 150 and the position of the core 150 relative to the heating zone 110, and the article 1 in use, help to direct the magnetic field so as to effect this penetration of the heater 20. This penetration of the heater 20 is indicated in FIG. 2 by the arrows M. The arrows M in FIG. 2 represent one instantaneous magnetic field line of the magnetic field. It can be seen that the magnetic field line follows a path that extends through the first portion 155 of the core 150, through the first arm 151 of the core 150 to the free end 151*a* of the first arm 151, from the free end 151*a* of the first arm 151 to the heater 20, through the heater 20, from the heater 20 to the free end 152*a* of the second arm 152 of the core 150, and through the second arm 152 to the first portion 155 of the core 150. If the varying magnetic field is an alternating magnetic field, the direction of the magnetic field line would reverse repeatedly but still substantially lie on this path.

The closer the free ends 151*a*, 152*a* of the first and second arms 151, 152 are to the heater 20 of the article 1, the greater the proportion of the magnetic field that will be directed through the heater 20. In some embodiments, the free ends 151*a*, 152*a* of the first and second arms 151, 152 of the core 150 may even contact the article 1 when the article 1 is located in the heating zone 110. Moreover, the smaller the surface area of each of the free ends 151*a*, 152*a* of the first and second arms 151, 152, the greater the concentration of the magnetic field passing through them in use. For example, in some embodiments, the free ends 151*a*, 152*a* may be convex, may be edges of respective tapered portions of the first and second arms 151, 152, or may comprise one or more surface features such as ridges or lumps. In some embodiments, the heater 20, or edges thereof, of the article 1 may be suitably shaped to concentrate the magnetic field passing therethrough.

Figure 3:
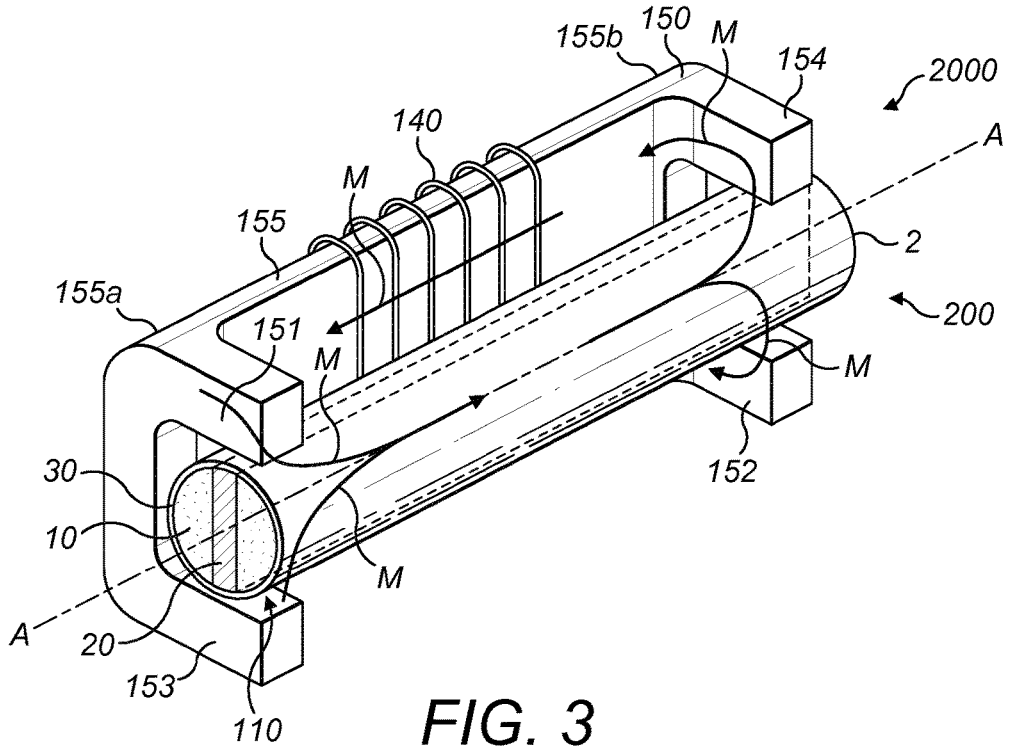
FIG. 3 shows a schematic perspective view of an example of another system, the system comprising an article comprising smokable material, and apparatus for heating the smokable material to volatilize at least one component of the smokable material.

Referring to FIG. 3, there is shown a schematic perspective view of an example of another system according to an embodiment of the present disclosure. The system 2000 comprises an article 2 comprising smokable material 10, and apparatus 200 for heating the smokable material 10 to volatilize at least one component of the smokable material 10. In this embodiment, the apparatus 200 is for heating the smokable material 10 to volatilize at least one component of the smokable material 10 without burning the smokable material 10.

In this embodiment, the article 2 is the same as the article 1 of the system 1000 of FIG. 2, albeit rotated through ninety degrees in FIG. 3, and so will not be described again in detail. Any of the herein-described possible variations to the article 1 of FIG. 2 may be made to the article 2 of FIG. 3 to form separate respective embodiments.

In this embodiment, the apparatus 200 comprises a heating zone 110 for receiving the article 2, and the magnetic field generator 120 shown schematically in FIG. 1. In this embodiment, the heating zone 110 is a recess in the apparatus 200. Moreover, in this embodiment, the heating zone 110 is a recess in the core 150. More specifically, in this embodiment, the recess 110 is elongate and has a longitudinal axis A-A. Furthermore, although not expressly shown in FIG. 3, in this embodiment the recess 110 is cylindrical with a substantially circular cross section in a plane normal to the longitudinal axis A-A of the recess 110. In other embodiments, the heating zone 110 may have a cross section other than circular and/or not be elongate and/or not be cylindrical. In this embodiment, the article 2 and the recess 110 are relatively dimensioned so that the article 2 is a snug fit in the recess 110.

In this embodiment, the core 150 of the magnetic field generator 120 comprises a magnetically permeable first portion 155, a magnetically permeable first arm 151, a magnetically permeable second arm 152, a magnetically permeable third arm 153, and a magnetically permeable fourth arm 154. The first and third arms 151, 153 extend from a first end 155*a* of the first portion 155 of the core 150, and the second and fourth arms 152, 154 extend from a second end 155*b* of the first portion 155 of the core 150. The second end 155*b* of the first portion 155 is opposite from the first end 155*a* of the first portion 155.

In this embodiment, the first and fourth arms 151, 154 of the core 150 are on a first side of the heating zone 110, and the second and third arms 152, 153 are on a second side of the heating zone 110. The first side of the heating zone 110 is opposite to the second side of the heating zone 110. The first arm 151 faces the third arm 153 through the heating zone 110, and the fourth arm 154 faces the second arm 152 through the heating zone 110. Therefore, the first and second arms 151, 152 of the core 150 are on opposite sides of the heating zone 110, and the third and fourth arms 153, 154 of the core 150 are on opposite sides of the heating zone 110. Portions of the heating zone 110 are thus effectively located between the first and third arms 151, 153 and between the second and fourth arms 152, 154. In this embodiment, the first portion 155 of the core 150 is elongate in a direction parallel to the longitudinal axis A-A of the heating zone 110. Furthermore, in this embodiment, each of the first, second, third and fourth arms 151, 152, 153, 154 of the core 150 is elongate in a direction perpendicular to the longitudinal axis A-A of the heating zone 110.

In this embodiment, a cross-sectional shape of the combination of the first and third arms 151, 153 of the core 150 in a plane normal to the longitudinal axis A-A of the heating zone 110 is substantially C-shaped. Similarly, in this embodiment, a cross-sectional shape of the combination of the second and fourth arms 152, 154 of the core 150 perpendicular to the longitudinal axis A-A of the heating zone 110 is substantially C-shaped. In other embodiments, these cross-sectional shapes may be other than C-shaped. In this embodiment, each of the first, second, third and fourth arms 151, 152, 153, 154 of the core 150 meets the first portion 155 of the core 150 at substantially ninety degrees. In other embodiments, this angle may be other than ninety degrees, such as between 10 and 170 degrees, between 30 and 150 degrees, between 45 degrees and 135 degrees, or between 60 and 120 degrees.

In this embodiment, the coil 140 is wound around the first portion 155 of the core 150. In this embodiment, the coil 140 is wound around neither of the first and second arms 151, 152 of the core 150. In this embodiment, the coil 140 extends generally along an axis that is parallel to the longitudinal axis A-A of the heating zone 110. The volume encircled by the coil 140 comprises the first portion 155 of the core 150 and is free of the heating zone 110. That is, the coil 140 does not encircle the heating zone 110. Accordingly, some portions of the coil 140 are located between the first portion 155 of the core 150 and the heating zone 110, and the first portion 155 of the core 150 is located between some other portions of the coil 140 and the heating zone 110.

The apparatus 200 and the article 2 are relatively dimensioned so that, when the article 2 located is in the heating zone 110, as shown in FIG. 3, the varying magnetic field generated by the magnetic field generator 120 penetrates the heater 20 of the article 2. The geometry of the core 150 and the position of the core 150 relative to the heating zone 110, and the article 2 in use, help to direct the magnetic field so as to effect this penetration of the heater 20. This penetration of the heater 20 is indicated in FIG. 3 by the arrows M. The arrows M in FIG. 3 represent a few instantaneous magnetic field lines of the magnetic field. It can be seen that the magnetic field lines follow paths that extend through the first portion 155 of the core 150, through the first or third arm 151, 153 of the core 150 to the heater 20, through the heater 20, from the heater 20 to the second or fourth arm 152, 14 of the core 150, and through the second or fourth arm 152, 154 to the first portion 155 of the core 150. If the varying magnetic field is an alternating magnetic field, the direction of the magnetic field lines would reverse repeatedly but still substantially lie on these paths.

The closer the arms 151, 152, 153, 154 of the core 150 are to the heater 20 of the article 2, the greater the proportion of the magnetic field that will be directed through the heater 20. In some embodiments, some or all of the arms 151, 152, 153, 154 of the core 150 may even contact the article 2 when the article 2 is located in the heating zone 110.

In a variation to the embodiment of FIG. 3, the arms 151, 152, 153, 154 of the core 150 may connect the first portion 155 of the core 150 to a second portion of the core 150. The second portion of the core may be on an opposite side of the heating zone 110 from the first portion 155 of the core 150. That is, the arms 151, 152, 153, 154 may not have respective free ends as illustrated, but instead may all be joined to one another by a portion of the core 150 similar to the first portion 155 of the core 150. The core 150 may be symmetrical about a plane that is parallel to the longitudinal axis of the heating zone 110. In such an embodiment, the first and second portions of the core 150 and the first and third arms 151, 153 of the core 150 would define a first window and the first and second portions of the core 150 and the second and fourth arms 152, 154 of the core 150 would define a second window. The longitudinal axis of the heating zone 110 may extend through one or both of the windows. Moreover, the heating zone 110 would extend through, or be accessible through, each of the windows. The magnetic field generator may comprise a second coil wound around the second portion of the core. In such a construction, a first set of magnetic field lines may follow the paths shown in FIG. 3, and a second set of magnetic field lines may follow paths that extend through the second portion of the core 150 in place of the first portion 155, through the arms 151, 152, 153, 154 and through the heater 20 of the article 2.

Figure 4:
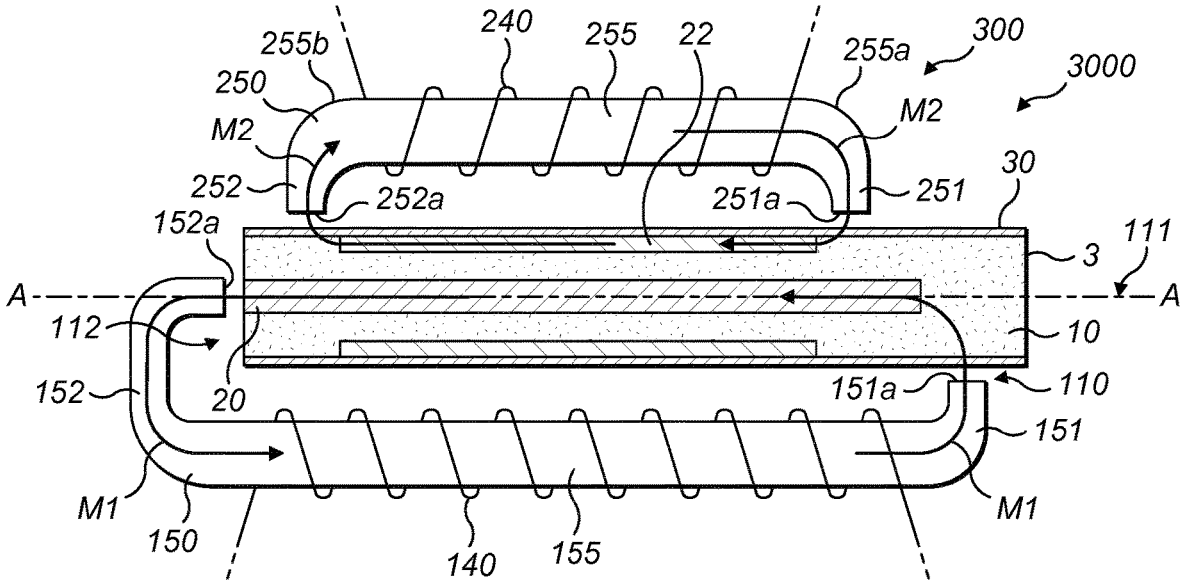
FIG. 4 shows a schematic partial cross-sectional view of an example of another system, the system comprising an article comprising smokable material, and apparatus for heating the smokable material to volatilize at least one component of the smokable material.

Referring to FIG. 4, there is shown a schematic perspective view of an example of another system according to an embodiment of the present disclosure. The system 3000 comprises an article 3 comprising smokable material 10, and apparatus 300 for heating the smokable material 10 to volatilize at least one component of the smokable material 10. In this embodiment, the apparatus 300 is for heating the smokable material 10 to volatilize at least one component of the smokable material 10 without burning the smokable material 10.

In this embodiment, the article 3 of the system 3000 comprises a mass of smokable material 10, a first heater 20, a second heater 22, and a cover 30.

Each of the first and second heaters 20, 22 comprises heating material that is heatable by penetration with a varying magnetic field. In this embodiment, the first heater 20 is in the form of a rod, and the second heater 22 is in the form of a tube that surrounds a portion of the first heater 20. In this embodiment, the first heater 20 is within the smokable material 10, and the second heater 22 surrounds the smokable material 10. Thus, the smokable material 10 is located between the first and second heaters 20, 22. In other embodiments, the first and second heaters 20, 22 may take different forms to those illustrated. However, it is preferred that the first heater 20 is out of contact with the second heater 22, as is the case in this embodiment.

The cover 30 of the article 3 encircles the smokable material 10 and the first and second heaters 20, 22 to help maintain the relative positions of the smokable material 10 and the heaters 20, 22. The cover 30 may be made of any suitable material, such as paper, card, a plastics material, or the like. In other embodiments, the cover 30 may take a different form or be omitted.

In this embodiment, the article 3 is elongate and cylindrical with a substantially circular cross section in a plane normal to a longitudinal axis of the article 3. However, in other embodiments, the article 3 may have a cross section other than circular and/or not be elongate and/or not be cylindrical. The article 3 may have proportions approximating those of a cigarette.

In this embodiment, the apparatus 300 comprises a heating zone 110 for receiving the article 3, and a magnetic field generator. The magnetic field generator comprises all the components of the magnetic field generator 120 shown schematically in FIG. 1, as well as a second magnetically permeable core 250 and a second coil 240 wound around the second core 250, as will be described in more detail below. The device 160 is for passing a varying current through the second coil 240. The device 160 is electrically connected between the electrical power source 130 and the second coil 240. The electrical connection between the device 160 and the second coil 240 may be in parallel or in series to the electrical connection between the device 160 and the first coil 140.

The device 160 may be controllable by the controller 170 to pass a varying electrical current through one of the first and second coils 140, 240 independently of passing a varying electrical current through the other of the first and second coils 140, 240. For example, the controller 170 may cause an electrical current to be passed through the first coil 140 for a first period of time, and to then cause an electrical current to be passed through the second coil 240 for a second period of time. The second period of time may commence on expiry of the first period of time. Such actions may effect progressive heating of the smokable material 10 of the article 3.

In this embodiment, the heating zone 110 is a recess in the apparatus 300. More specifically, in this embodiment, the recess 110 has an open first end 111 through which the article 3 is insertable into the recess 110, a second end 112 opposite the first end 111, and one or more sides connecting the first and second ends 111, 112. The recess 110 is elongate and has a longitudinal axis A-A. Furthermore, although not expressly shown in FIG. 4, in this embodiment the recess 110 is cylindrical with a substantially circular cross section in a plane normal to the longitudinal axis A-A of the recess 110. In other embodiments, the heating zone 110 may have a cross section other than circular and/or not be elongate and/or not be cylindrical. In this embodiment, the article 3 and the recess 110 are relatively dimensioned so that the article 3 is a snug fit in the recess 110.

In this embodiment, the first core 150 of the magnetic field generator 120 comprises a magnetically permeable first portion 155, a magnetically permeable first arm 151, and a magnetically permeable second arm 152. The first arm 151 extends from a first end 155*a* of the first portion 155 of the first core 150, and the second arm 152 extends from a second end 155*b* of the first portion 155 of the first core 150. The second end 155*b* of the first portion 155 is opposite from the first end 155*a* of the first portion 155.

In this embodiment, the first and second arms 151, 152 of the first core 150 are on different sides of the heating zone 110. More specifically, in this embodiment, the first and second arms 151, 152 of the first core 150 have respective free ends 151*a*, 152*b* on different sides of the heating zone 110. In this embodiment, the first arm 151 of the first core 150 is at the side, or one of the sides, of the recess 110, and the second arm 152 of the first core 150 is at the second end 112 of the recess 110. More specifically, the free end 151*a* of the first arm 151 is at the side, or one of the sides, of the recess 110, and the free end 152*a* of the second arm 152 is at the second end 112 of the recess 110. In this embodiment, the longitudinal axis A-A of the heating zone 110 passes through the free end 152*a* of the second arm 152. The respective free ends 151*a*, 152*a* of the first and second arms 151, 152 of the first core 150 face the heating zone 110. This arrangement helps provide that some magnetic field lines M1 follow a first path that extends from the first core 150 and into the first heater 20, whereas other magnetic field lines M2 follow a second path that extends from the second core 250 and into the second heater 22. That is, by positioning the second arm 152 at the second end 112 of the recess 110, magnetic flux is encouraged to flow from the first core 150 into the first heater 20, rather than into the second heater 22.

In this embodiment, a cross-sectional shape of the first arm 151 of the first core 150 parallel to the longitudinal axis A-A of the heating zone 110 is substantially L-shaped. In other embodiments, the cross-sectional shape may be other than L-shaped, such as a 45-degree arc or bend. Further, in this embodiment, a cross-sectional shape of the second arm 152 of the first core 150 parallel to the longitudinal axis A-A of the heating zone 110 is substantially C-shaped. In other embodiments, the cross-sectional shape may be other than C-shaped.

In this embodiment, the coil 140 is wound around the first portion 155 of the first core 150. In this embodiment, the coil 140 is wound around neither of the first and second arms 151, 152 of the first core 150. In this embodiment, the coil 140 extends generally along an axis that is parallel to the longitudinal axis A-A of the heating zone 110. The volume encircled by the coil 140 comprises the first portion 155 of the first core 150 and is free of the heating zone 110. That is, the coil 140 does not encircle the heating zone 110. Accordingly, some portions of the coil 140 are located between the first portion 155 of the first core 150 and the heating zone 110, and the first portion 155 of the first core 150 is located between some other portions of the coil 140 and the heating zone 110.

The apparatus 300 and the article 3 are relatively dimensioned so that, when the article 3 is located is in the heating zone 110, as shown in FIG. 4, the varying magnetic field generated by the first coil 140 of the magnetic field generator 120 penetrates the first heater 20 of the article 3. The geometry of the first core 150 and the position of the first core 150 relative to the heating zone 110, and the article 3 in use, help to direct the magnetic field so as to effect this penetration of the first heater 20. This penetration of the first heater 20 is indicated in FIG. 4 by the arrows M1. The arrows M1 in FIG. 4 represent one instantaneous magnetic field line of the magnetic field. It can be seen that the magnetic field line follows a path that extends through the first portion 155 of the first core 150, through the first arm 151 of the first core 150 to the first heater 20, through the first heater 20, from the first heater 20 to the second arm 152 of the first core 150, and through the second arm 152 to the first portion 155 of the first core 150. If the varying magnetic field is an alternating magnetic field, the direction of the magnetic field line would reverse repeatedly but still substantially lie on this path.

The magnetically permeable second core 250 comprises a magnetically permeable first portion 255, a magnetically permeable first arm 251, and a magnetically permeable second arm 252. The first arm 251 extends from a first end 255*a* of the first portion 255 of the second core 250, and the second arm 252 extends from a second end 255*b* of the first portion 255 of the second core 250. The second end 255*b* of the first portion 255 is opposite from the first end 255*a* of the first portion 255.

In this embodiment, the first and second arms 251, 252 of the second core 250 are on the same side of the heating zone 110. In other embodiments, the first and second arms 251, 252 of the second core 250 may be on different sides of the heating zone 110, such as opposite sides. Moreover, the first and second arms 251, 252 of the second core 250 have respective free ends 251*a*, 252*a* that face the heating zone 110.

In this embodiment, a cross-sectional shape of each of the first and second arms 251, 252 of the second core 250 parallel to the longitudinal axis A-A of the heating zone 110 is substantially L-shaped. In other embodiments, the cross-sectional shape may be other than L-shaped, such as a 45-degree arc or bend.

In this embodiment, the second coil 240 is wound around the first portion 255 of the second core 250. In this embodiment, the second coil 240 is wound around neither of the first and second arms 251, 252 of the second core 250. In this embodiment, the second coil 240 extends generally along an axis that is parallel to the longitudinal axis A-A of the heating zone 110. The volume encircled by the coil 240 comprises the first portion 255 of the second core 250 and is free of the heating zone 110. That is, the second coil 240 does not encircle the heating zone 110. Accordingly, some portions of the second coil 240 are located between the first portion 255 of the second core 250 and the heating zone 110, and the first portion 255 of the second core 250 is located between some other portions of the second coil 240 and the heating zone 110.

The apparatus 300 and the article 3 are relatively dimensioned so that, when the article 3 is located is in the heating zone 110, as shown in FIG. 4, the varying magnetic field generated by the second coil 240 penetrates the second heater 22 of the article 3. The geometry of the second core 250 and the position of the second core 250 relative to the heating zone 110, and the article 3 in use, help to direct the magnetic field so as to effect this penetration of the second heater 22. This penetration of the second heater 22 is indicated in FIG. 4 by the arrows M2. The arrows M2 in FIG. 4 represent one instantaneous magnetic field line of the magnetic field. It can be seen that the magnetic field line follows a path that extends through the first portion 255 of the second core 250, through the first arm 251 of the second core 250 to the second heater 22, through the second heater 22, from the second heater 22 to the second arm 252 of the second core 250, and through the second arm 252 to the first portion 255 of the second core 250. If the varying magnetic field is an alternating magnetic field, the direction of the magnetic field line would reverse repeatedly but still substantially lie on this path.

The closer the arms 151, 152, 251, 252 of the first and second cores 150, 250 are to the first and second heaters 20, 22 of the article 3, the greater the proportion of the magnetic fields that will be directed through the first and second heaters 20, 22. In some embodiments, some or all of the arms 151, 152, 251, 252 of the cores 150, 250 may even contact the article 3 when the article 3 is located in the heating zone 110. Moreover, the smaller the surface area of each of the free ends 151*a*, 152*a*, 251*a*, 252*a* of the arms 151, 152, 251, 252, the greater the concentration of the magnetic field passing through them in use. The free ends 151*a*, 152*a*, 251*a*, 252*a* may take any of the forms discussed above.

In each of the above-described embodiments, the first portion 155, 255 of the first or second core 150, 250 is unitary or integral with each of the first and second arms 151, 152 of that core 150, 250. However, in some embodiments, the first portion 155, 255 of the first or second core 150 may be non-unitary with, and fastened to, one or both of the first and second arms 151, 152 of that core 150, 250.

In FIGS. 1 to 4, the first and second coils 140, 240 are shown as having only a few windings. However, in reality, each of the first and second coils 140, 240 could comprise tens or hundreds of windings.

In FIGS. 1 to 4, the heating zone 110 is a recess 110. In other embodiments, the heating zone 110 may be other than a recess, such as a shelf, a surface, or a projection, and may require mechanical mating with the article 1, 2, 3 in order to co-operate with the article 1, 2, 3. The recess 110 may be defined by the combination of the core(s) 150, 250 and other, less or non-magnetically permeable material, such as a housing of the apparatus 100, 200, 300. The housing may be made, for example, from a plastics material.

In some embodiments, an impedance of the coil 140, 240 of the magnetic field generator 120 is equal, or substantially equal, to an impedance of the heater 20, 22 in the article 1, 2, 3. If the impedance of the heater 20, 22 of the article 1, 2, 3 were instead lower than the impedance of the coil 140, 240, then the voltage generated across the heater 20, 22 in use may be lower than the voltage that may be generated across the heater 20, 22 when the impedances are matched. Alternatively, if the impedance of the heater 20, 22 of the article 1, 2, 3 were instead higher than the impedance of the coil 140, 240, then the electrical current generated in the heater 20, 22 in use may be lower than the current that may be generated in the heater 20, 22 when the impedances are matched. Matching the impedances may help to balance the voltage and current to maximize the heating power generated by the heater 20, 22 of the article 1, 2, 3 when heated in use.

In each of the embodiments discussed above, the heating material of the heater 20, 22 is aluminum. However, in other embodiments, the heating material may comprise one or more materials selected from the group consisting of: an electrically-conductive material, a magnetic material, and a magnetic electrically-conductive material. In some embodiments, the heating material may comprise a metal or a metal alloy. In some embodiments, the heating material may comprise one or more materials selected from the group consisting of: aluminum, gold, iron, nickel, cobalt, conductive carbon, graphite, plain-carbon steel, stainless steel, ferritic stainless steel, copper, and bronze. Other heating material(s) may be used in other embodiments. In some embodiments, the heating material may be magnetic. It has also been found that, when magnetic electrically-conductive material is used as the heating material, magnetic coupling between the magnetic electrically-conductive material and an electromagnet of the apparatus in use may be enhanced. In addition to potentially enabling magnetic hysteresis heating, this can result in greater or improved Joule heating of the heating material, and thus greater or improved heating of the smokable material 20.

In each of the articles 1, 2, 3 shown in FIGS. 2 to 4, the heating material of the heater 20, 22 is in contact with the smokable material 10. Thus, when the heating material is heated by penetration with a varying magnetic field, heat may be transferred directly from the heating material to the smokable material 10. In other embodiments, the heating material may be kept out of contact with the smokable material 10. For example, in some embodiments, the article 1, 2, 3 may comprise a thermally-conductive barrier that is free of heating material and that spaces the heating material from the smokable material 10. In some embodiments, the thermally-conductive barrier may be a coating on the heating material. The provision of such a barrier may be advantageous to help to dissipate heat to alleviate hot spots in the heating material.

In each of the embodiments discussed above, the heating material may have a skin depth, which is an exterior zone within which most of an induced electrical current and/or induced reorientation of magnetic dipoles occurs. By providing that the component comprising the heating material has a relatively small thickness, a greater proportion of the heating material may be heatable by a given varying magnetic field, as compared to heating material in a component having a depth or thickness that is relatively large as compared to the other dimensions of the component. Thus, a more efficient use of material is achieved. In turn, costs are reduced.

In some embodiments, a component comprising the heating material may comprise discontinuities or holes therein. Such discontinuities or holes may act as thermal breaks to control the degree to which different regions of the smokable material 10 are heated in use. Areas of the heating material with discontinuities or holes therein may be heated to a lesser extent that areas without discontinuities or holes. This may help progressive heating of the smokable material 10, and thus progressive generation of vapor, to be achieved. Such discontinuities or holes may, on the other hand, be used to optimize the creation of complex eddy currents in use.

In each of the above described embodiments, the smokable material 10 comprises tobacco. However, in respective variations to each of these embodiments, the smokable material 10 may consist of tobacco, may consist substantially entirely of tobacco, may comprise tobacco and smokable material other than tobacco, may comprise smokable material other than tobacco, or may be free of tobacco. In some embodiments, the smokable material 10 may comprise a vapor or aerosol forming agent or a humectant, such as glycerol, propylene glycol, triacetin, or diethylene glycol.

In each of the above described embodiments, the article 1, 2, 3 is a consumable article. Once all, or substantially all, of the volatilizable component(s) of the smokable material 10 in the article 1, 2, 3 has/have been spent, the user may remove the article 1, 2, 3 from the apparatus 100, 200, 300 and dispose of the article 1, 2, 3. The user may subsequently re-use the apparatus 100, 200, 300 with another of the articles 1, 2, 3. However, in other respective embodiments, the article 1, 2, 3 may be non-consumable, and the apparatus 100, 200, 300 and the article 1, 2, 3 may be disposed of together once the volatilizable component(s) of the smokable material 20 has/have been spent.

In some embodiments, the apparatus 100, 200, 300 is sold, supplied or otherwise provided separately from the articles 1, 2, 3 with which the apparatus 100, 200, 300 is usable. However, in some embodiments, the apparatus 100, 200, 300 and one or more of the articles 1, 2, 3 may be provided together as a system 1000, 2000, 3000, such as a kit or an assembly, possibly with additional components, such as cleaning utensils.

In some embodiments, the apparatus 100, 200, 300 may comprise a heater comprising heating material that is heatable by penetration with a varying magnetic field. The core(s) may be shaped so as to encourage the flow of magnetic flux through the heater of the apparatus 100, 200, 300. Such a heater of the apparatus 100, 200, 300 may, for example, comprise a tubular heater that defines the heating zone 110. In some such embodiments, the article 1, 2, 3 may be free of heating material, and the smokable material may be heated by heat transferred from the heater of the apparatus 100, 200, 300.

Embodiments of the disclosure could be implemented in a system comprising any one of the articles discussed herein, and any one of the apparatuses discussed herein, wherein the apparatus itself has heating material, such as in a susceptor, for heating by penetration with the varying magnetic field generated by the magnetic field generator. Heat generated in the heating material of the apparatus could be transferred to the article to heat, or further heat, the smokable material therein when the article is in the heating zone.

In order to address various issues and advance the art, the entirety of this disclosure shows by way of illustration and example various embodiments in which the claimed invention may be practiced and which provide for superior apparatus for heating smokable material to volatilize at least one component of the smokable material, and superior systems comprising such apparatus and articles for use with such apparatus. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An apparatus for heating smokable material to volatilize at least one component of the smokable material, the apparatus comprising:

a heating zone for receiving an article, the article comprising smokable material and heating material that is heatable by penetration with a varying magnetic field to heat the smokable material; and a magnetic field generator for generating a varying magnetic field that penetrates the heating zone, the magnetic field generator comprising a magnetically permeable core and a coil;

wherein the core comprises a magnetically permeable first portion and magnetically permeable first and second arms extending from the first portion, the first and second arms defining respective free ends that face each other through the heating zone, wherein the coil is wound around the first portion of the core, and wherein the first and second arms of the core are on different sides of the heating zone, and wherein the heating zone is elongate, wherein each of the first and second arms of the core is elongate in a direction parallel to a longitudinal axis of the heating zone.

2. The apparatus of claim 1, wherein the first and second arms of the core extend from opposite ends of the first portion of the core.

3. An apparatus for heating smokable material to volatilize at least one component of the smokable material, the apparatus comprising:

a heating zone for receiving an article, the article comprising smokable material and heating material that is heatable by penetration with a varying magnetic field to heat the smokable material; and a magnetic field generator for generating a varying magnetic field that penetrates the heating zone, the magnetic field generator comprising a magnetically permeable core and a coil;

wherein the core comprises a magnetically permeable first portion and magnetically permeable first and second arms extending from the first portion, the first and second arms defining respective free ends that face each other through the heating zone, wherein the coil is wound around the first portion of the core, and wherein the first and second arms of the core are on different sides of the heating zone, wherein the first and second arms of the core are on opposite sides of the heating zone, and wherein the core comprises third and fourth arms extending from the first portion, the third and fourth arms defining respective free ends that face each other through the heating zone, and wherein the third and fourth arms of the core are on opposite sides of the heating zone, and wherein each of the first, second, third, and fourth arms of the core is elongate in a direction parallel to a longitudinal axis of the heating zone.

4. The apparatus of claim 3, wherein the first and third arms of the core extend from a first end of the first portion of the core, and the second and fourth arms of the core extend from an opposite second end of the first portion of the core.

5. The apparatus of claim 3, wherein the first, second, third and fourth arms connect the first portion of the core to a second portion of the core, and wherein the second portion of the core is on an opposite side of the heating zone from the first portion of the core.

6. An apparatus for heating smokable material to volatilize at least one component of the smokable material, the apparatus comprising:

a heating zone for receiving an article, the article comprising smokable material and heating material that is heatable by penetration with a varying magnetic field to heat the smokable material; and a magnetic field generator for generating a varying magnetic field that penetrates the heating zone, the magnetic field generator comprising a magnetically permeable core and a coil;

wherein the core comprises a magnetically permeable first portion and magnetically permeable first and second arms extending from the first portion, the first and second arms defining respective free ends that face each other through the heating zone, wherein the coil is wound around the first portion of the core, and wherein the first and second arms of the core are on different sides of the heating zone, wherein the heating zone has an open first end through which the article is insertable into the heating zone, a second end opposite the first end, and one or more sides connecting the first and second ends;

wherein the first arm of the core is at the side, or one of the sides, of the heating zone, and the second arm of the core is at the second end of the heating zone, and wherein each of the first and second arms of the core is elongate in a direction parallel to a longitudinal axis of the heating zone.

7. The apparatus of claim 1, wherein the magnetic field generator comprises a magnetically permeable second core and a second coil; and wherein the second core comprises a magnetically permeable first portion and magnetically permeable first and second arms extending from the first portion, wherein the second coil is wound around the first portion of the second core, and wherein the first and second arms of the second core have respective free ends that face the heating zone.

8. The apparatus of claim 1, wherein the first portion of the core is unitary with each of the first and second arms of the core.

9. The apparatus of claim 1, wherein the heating zone is a recess in the apparatus or a recess in the core.

10. A system, comprising:

an article comprising smokable material and a heater, wherein the heater comprises heating material that is heatable by penetration with a varying magnetic field to heat the smokable material; and an apparatus for heating the smokable material to volatilize at least one component of the smokable material, the apparatus comprising:

a heating zone for receiving the article, and a magnetic field generator for generating a varying magnetic field that penetrates the heater when the article is in the heating zone, the magnetic field generator comprising a magnetically permeable core and a coil;

wherein the core comprises a magnetically permeable first portion and magnetically permeable first and second arms extending from the first portion, the first and second arms defining respective free ends that face each other through the heating zone, wherein the coil is wound around the first portion of the core, and wherein the first and second arms of the core are on different sides of the heating zone, and wherein each of the first and second arms of the core is elongate in a direction parallel to a longitudinal axis of the heating zone.

11. The system of claim 10, wherein the magnetic field generator comprises a magnetically permeable second core and a second coil; and wherein the second core comprises a magnetically permeable first portion and magnetically permeable first and second arms extending from the first portion, wherein the second coil is wound around the first portion of the second core, and wherein the first and second arms of the second core have respective free ends that face the heating zone.

12. The system of claim 10, wherein the smokable material comprises at least one of tobacco or one or more humectants.

13. The system of claim 10, wherein the heating material comprises one or more materials selected from the group consisting of: an electrically-conductive material, a magnetic material, and a magnetic electrically-conductive material.

14. The system of claim 10, wherein the heating material comprises a metal or a metal alloy.

15. The system of claim 10, wherein the heating material comprises one or more materials selected from the group consisting of: aluminum, gold, iron, nickel, cobalt, conductive carbon, graphite, plain-carbon steel, stainless steel, ferritic stainless steel, copper, and bronze.

* * * * *